US006698124B2

(12) United States Patent
Kump et al.

(10) Patent No.: US 6,698,124 B2
(45) Date of Patent: Mar. 2, 2004

(54) SIGN HOLDER WITH HINGE

(75) Inventors: Daniel J. Kump, Gates Mills, OH (US); Paul A. Mueller, Wadsworth, OH (US); Stephen D. Wamsley, Lakewood, OH (US)

(73) Assignee: Fasteners For Retail, Inc., Cleveland, OH (US)

( * ) Notice: Subject to any disclaimer, the term of this patent is extended or adjusted under 35 U.S.C. 154(b) by 45 days.

(21) Appl. No.: 09/817,654

(22) Filed: Mar. 26, 2001

(65) Prior Publication Data

US 2002/0020095 A1 Feb. 21, 2002

Related U.S. Application Data

(63) Continuation-in-part of application No. 09/261,874, filed on Mar. 3, 1999, now Pat. No. 6,289,618, which is a continuation-in-part of application No. 09/054,064, filed on Apr. 2, 1998, now abandoned.

(60) Provisional application No. 60/084,854, filed on May 8, 1998.

(51) Int. Cl.[7] ..... G09F 3/18

(52) U.S. Cl. ..... 40/642.02; 248/220.41

(58) Field of Search ..... 40/642.02; D20/42, D20/43, 44; 248/220.41, 220.43, 223.31, 223.41, 225.11, 224.51

(56) References Cited

U.S. PATENT DOCUMENTS

| | | | | |
|---|---|---|---|---|
| 2,997,082 A | | 8/1961 | Schubert et al. | |
| 3,250,235 A | | 5/1966 | McDonnell | 248/220.42 |
| 3,572,512 A | * | 3/1971 | Schray | |
| 3,897,926 A | | 8/1975 | Silver | 248/220.42 X |
| 4,026,508 A | | 5/1977 | Ziegler | 211/59.1 X |
| 4,303,217 A | | 12/1981 | Garfinkle | 211/59.1 X |
| 4,452,360 A | | 6/1984 | Barnes | 211/59.1 X |
| 4,557,064 A | | 12/1985 | Thompson | |
| 4,783,033 A | | 11/1988 | Valiulis | 211/59.1 X |
| 4,881,707 A | * | 11/1989 | Garfinkle | 40/642 X |
| 4,905,846 A | | 3/1990 | Calvert | 248/220.42 X |
| 4,909,464 A | * | 3/1990 | Levine et al. | 40/642 X |
| 4,960,258 A | | 10/1990 | Stocker et al. | 40/600 X |
| 5,060,897 A | | 10/1991 | Thalenfeld | 211/59.1 X |
| 5,080,238 A | | 1/1992 | Hochman | 211/59.1 |
| 5,356,104 A | * | 10/1994 | Rosenberg et al. | 248/225.1 X |
| 5,664,749 A | | 9/1997 | Kump et al. | 248/220.22 |
| 5,683,003 A | | 11/1997 | Gebka | 40/666 X |
| 6,082,687 A | | 7/2000 | Kump et al. | 248/220.41 |
| 6,289,618 B1 | | 9/2001 | Kump et al. | 40/657 |
| 6,341,755 B1 | | 1/2002 | Kump | 248/220.41 |
| D454,918 S | | 3/2002 | Wamsley et al. | D20/43 |
| 6,354,546 B1 | | 3/2002 | Mueller | 248/220.42 |
| 6,438,882 B1 | * | 8/2002 | Reynolds | 40/642.02 |

OTHER PUBLICATIONS

Fasteners For Retail, 1995 Buyers Guide, pp. 16, 22, Mar. 1995.*

FFr Yellow Pages™, 1999 Catalogue. pp. 69,45,66.

* cited by examiner

*Primary Examiner*—Joanne Silbermann
(74) *Attorney, Agent, or Firm*—Fay, Sharpe, Fagan, Minnich & McKee, LLP

(57) ABSTRACT

A multi-component, interchangeable display system 500 is connectable with a support surface 276 such as an upright rail of a shelving system. The display system provides for the display of a variety of signs 652 on interchangeable display members 504 which may be slidably connected to a support bracket R. The support bracket includes a planar support body 506 having spaced fingers 508,510 which selectively engage openings 614 in the support rail. The display member includes a hinge portion 654, formed from a resiliently flexible material, which allows the sign to be bumped without damage.

15 Claims, 19 Drawing Sheets

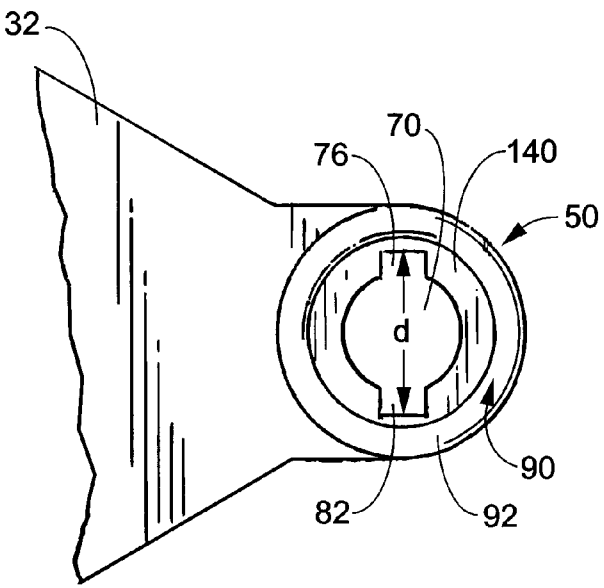
FIG. 7
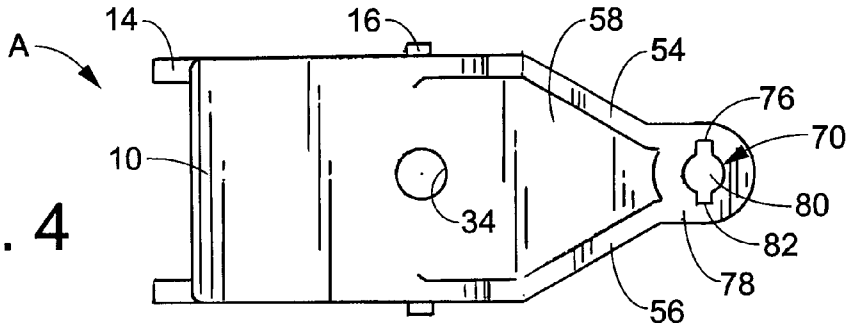
FIG. 4
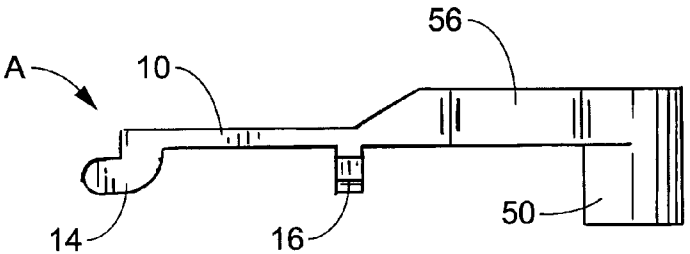
FIG. 5
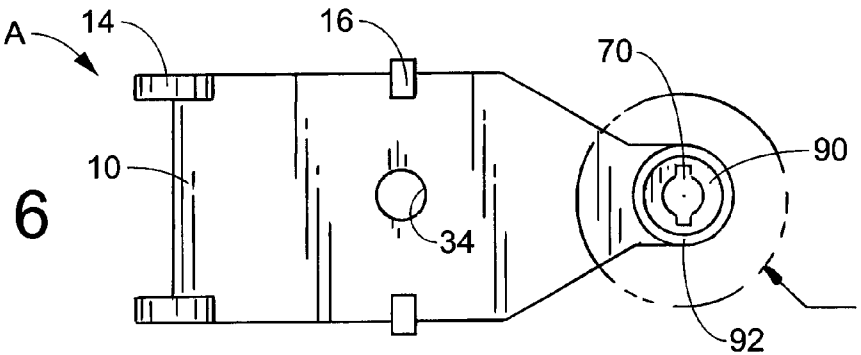
FIG. 6
FIG. 7

SIGN HOLDER WITH HINGE

This application is a Continuation-In-Part of U.S. patent application Ser. No. 09/261,874, now U.S. Pat. No. 6,289,618 filed Mar. 3, 1999, which is a Continuation-In-Part of U.S. patent application Ser. No. 09/054,064, now abandoned filed Apr. 2, 1998, and claims the priority of U.S. Provisional Application Ser. No. 60/084,854, filed May 8, 1998.

BACKGROUND OF THE INVENTION

The present invention relates generally to merchandising systems employed in retail stores. More particularly, it relates to an improved sign holder system which can be secured to a vertical support surface.

Merchandise signs for displaying product information and hangers for small products, such as packages of snack foods, batteries, household items, and the like, are commonly displayed on brackets mounted to the front edge of a horizontally extending shelf or to an upright shelf support, in supermarkets and other stores with the shelves themselves being used to support other products. Gebka (U.S. Pat. No. 5,683,003) discloses a merchandise hanger which is attached by a laterally extending foot to a front portion of a horizontal shelf.

Because such display signs and hangers sometimes extend outward into the aisle of the store, they are prone to damage by accidental knocks from passing customers. Also, the signs or products may be displaced from the bracket or damaged by the knocks. Occasionally, the protruding items may injure a shopper walking down the aisle.

Accordingly, it has been considered desirable to develop a new and improved sign holder which overcomes the foregoing difficulties and others while providing better and more advantageous overall results.

BRIEF SUMMARY OF THE INVENTION

In an exemplary embodiment of the present invention, a display system includes a generally planar support body. A mounting member extends from a surface of the support body and selectively engages an associated fixture. A display member is selectively connectable with the support body. At least one of the display member and the support body includes a hinge portion which allows the display member to pivot in relation to the support body when a force is applied to the display member.

In another exemplary embodiment of the present invention, a display system includes a generally planar support body. A mounting member extends from a surface of the support body and includes two spaced fingers extending away from the support member. The two spaced fingers selectively engage suitably shaped and positioned openings in an associated fixture. A display member is selectively connectable with the support body. At least one of the display member and the support body includes a hinge member which allows the display member to pivot in relation to the support body when a force is applied to the display member, the hinge member including an upwardly open housing extending forwardly of a second surface of one of the support member and the display member. The housing includes a bore. The other of the support member and the display member includes a stem selectively received in the bore of the housing.

In another exemplary embodiment, a display system includes a generally planar support body. A mounting member extends from a surface of the support body. The mounting member selectively engages an associated fixture. A display member is selectively connectable with the support body. The display member includes a hinge portion and a sign holding portion connected therewith for selectively holding an associated sign. The hinge portion flexes when a force is applied to the display member.

In another exemplary embodiment, a display system includes a generally planar support body having opposed first and second surfaces. A mounting member extends from the first surface of the support body for selectively engaging an associated fixture. A display member is selectively connectable with the support body such that it extends from a second surface of the support body. At least one of the display member and the support body includes a hinge portion which allows at least a portion of the display member to pivot in relation to the support body when a force is applied to the display member, the support body including a projection extending from the second surface, the projection engaging a portion of the display member.

In another exemplary embodiment, a display system includes a generally planar support body having opposed first and second sides. A mounting member extends away from the first side of the support body for selectively engaging an associated fixture. A display member is selectively connectable with at least one of the first and second sides of the support body, the display member including a hinge portion which flexes when a force is applied to a portion of the display member.

In another exemplary embodiment, a mounting bracket includes a generally planar support body. The body includes at least one groove located on a first surface thereof for selectively receiving a flange on an associated display member. At least one mounting member extends from the first surface of the support body for selectively engaging an associated fixture. A shelf extends from a second surface of the support body. The shelf contacts a generally planar portion of the associated display member when the display member is received on the support member. The generally planar portion of the display member is connected with the flange.

In another exemplary embodiment, a method of displaying a sign includes mounting a support body on a suitable fixture and connecting a display member with the support body. The display member includes a hinge portion which flexes when a force is applied to a portion of the display member and returns generally to its original position when the force is removed. The method further includes inserting the sign in a channel formed in the distal end of the display member.

In another exemplary embodiment, a display system includes a mounting bracket which is selectively mountable on an associated fixture in a generally vertical orientation. A display member is selectively connectable with the mounting bracket. The display member includes an engagement portion configured for frictionally engaging at least a portion of the mounting bracket and a sign holding portion for holding a sign, and a hinge. The sign holding portion is connected with the engagement portion via the hinge and is pivotable relative to the engagement portion when a force is applied thereto. The sign holding portion returns to its original position when the force is removed.

The benefits and advantages of the present invention will become apparent to those skilled in the art upon a reading and understanding of the following detailed specification.

BRIEF DESCRIPTION OF THE DRAWINGS

The invention takes form in certain parts and arrangements of parts, preferred embodiments of which will be described in detail in this specification and illustrated in the accompanying drawings which form a part hereof and wherein:

FIG. 4 is a top plan view of the mounting bracket of FIG. 1;

FIG. 5 is a side elevational view of the mounting bracket of FIG. 1;

FIG. 6 is a bottom plan view of the mounting bracket of FIG. 1;

FIG. 7 is a greatly enlarged bottom plan view of a portion of the mounting bracket of FIG. 6;

DETAILED DESCRIPTION OF THE PREFERRED EMBODIMENTS

Figure 1:
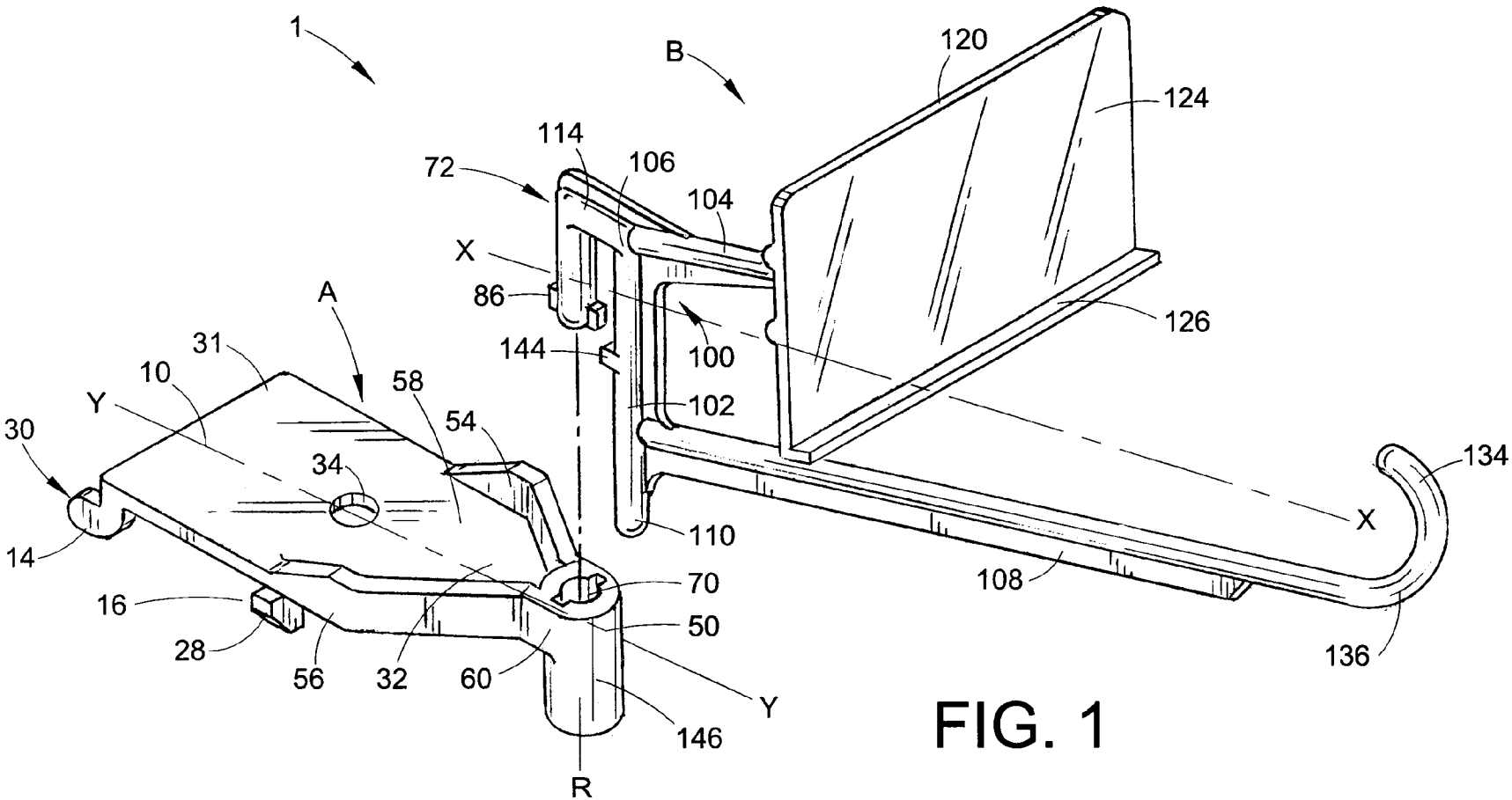
FIG. 1 is an exploded perspective view of a) a mounting bracket and b) a merchandise hanger and label holder of a multi-component, interchangeable, pivotable display system, in accordance with a first preferred embodiment of the present invention.

Referring now to the drawings, wherein the showings are for purposes of illustrating preferred embodiments of the invention only and are not for purposes of limiting same, FIG. 1 shows a multi-component interchangeable display system 1, or pivotable merchandise and display hanger which includes a first component, in the form of a mounting base or bracket A and a second component, in the form of a pivotable display member B, according to a first preferred embodiment of the present invention. Both the bracket A and the display member B are preferably molded from a relatively rigid, but resiliently yielding plastic, such as polypropylene. As will be described in greater detail herein, the pivotable display member can have a variety of configurations for displaying labels, hanging merchandise, or both.

Figure 2:
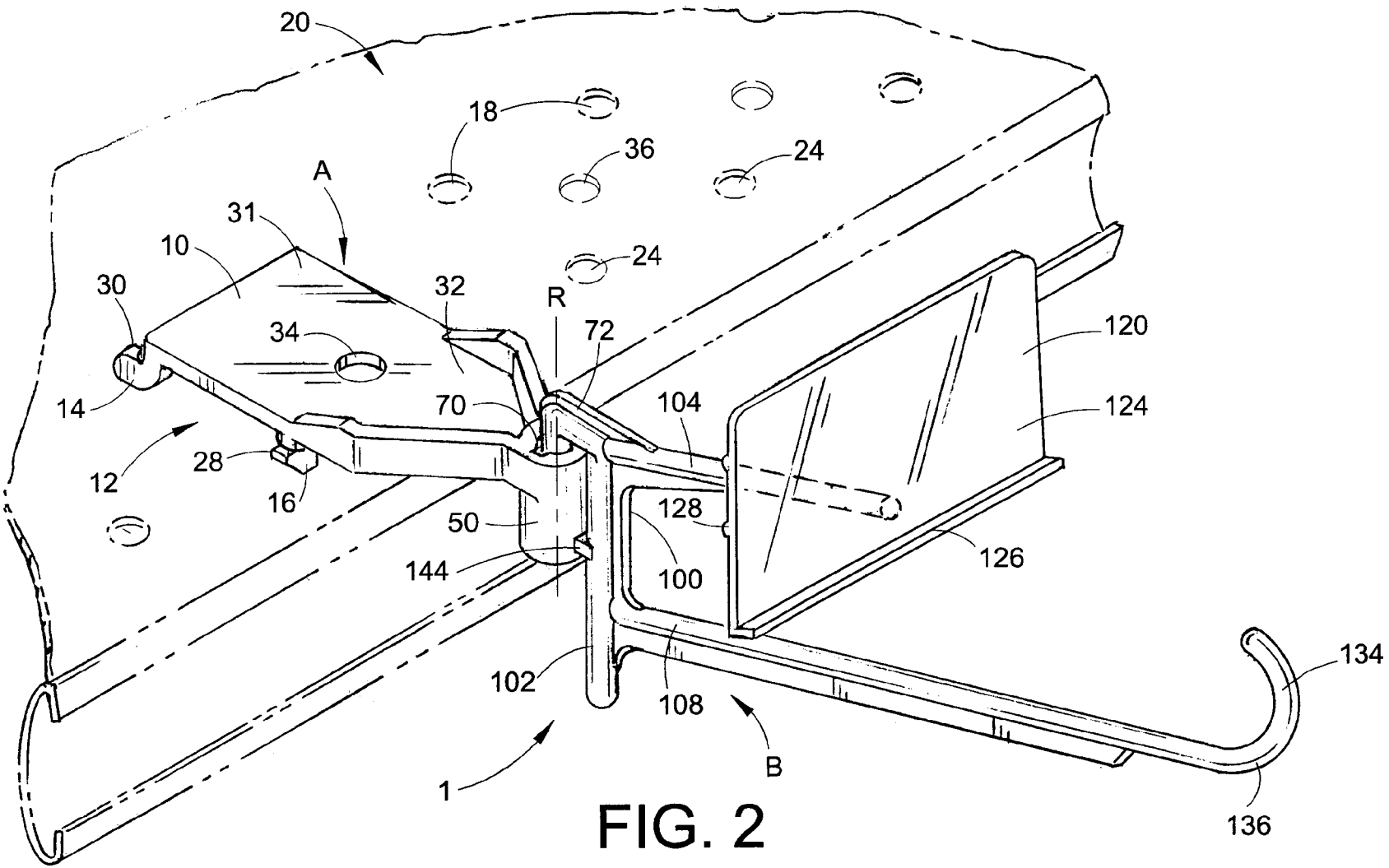
FIG. 2 is a perspective view of an assembled horizontal mounting bracket and merchandise hanger and label holder of FIG. 1, secured in apertures on a shelf.

The horizontal mounting bracket A is configured for attaching the display member to a rigid support, such as a horizontal shelf having vertically extending apertures therein. In the embodiment of FIG. 1, the mounting bracket A includes a generally horizontal plate member 10, adapted to fit against an upper surface of the shelf. With reference also to FIG. 2, mounting fingers 12 for the plate member 10 preferably include a rearward pair of feet 14 and a forward pair of hooks 16. These extend generally downwardly and radially outwardly from a lower surface of the plate member 10, and are preferably formed integrally with the bracket. The rearward pair of feet 14 are dimensioned to be received into a selected spaced pair of rearward apertures 18 in a second row of apertures in a shelf 20. The pair of hooks 16 snap into a corresponding pair of forward apertures 24 in a first row of apertures in the shelf 20.

To insert the bracket into apertures 18, 24 in the shelf 20, the plate member 10 is held at a slight angle from the horizontal and the rearward feet are slid into the two spaced rearward apertures 18 in the second row of apertures to position the mounting bracket A on the shelf 20. The plate member is then brought into a horizontal orientation and the forward hooks 16 snapped into the two forward apertures 24 in the first row of apertures on the shelf. The hooks 16 preferably include laterally extending fins 28 which tend to grip a lower surface of the shelf, restricting upward movement of the plate member 10. Similarly, the feet 14 each include a flat upper surface 30 which engages the lower surface of the shelf. The feet and hooks 14 and 16 provide a simple means of supporting the plate member 10 in a generally horizontal position on the shelf 20 without the need for screws or other fixing means. The plate member 10 has a rectangular rear portion 31, to which the feet and legs are attached, and a generally V-shaped front end or forward portion 32. Due to the resilient material from which the bracket A is made, the plate member 10 can be disengaged from the shelf 20 by lifting up on the front end 32 of the plate member 10 until the hooks 16 snap out of the forward apertures 24 and then lifting the plate member forwardly and upwardly to release the feet 14.

With continued reference to FIGS. 1 and 2, the plate member 10 optionally includes a securing aperture 34 in addition to, or in place of, the feet 14 and hooks 16, for attaching the plate member to the shelf 20. The securing aperture 34 is positioned generally centrally on the plate member and extends vertically therethrough. A conventional clip, screw, or other suitable fixing member, passes through the securing aperture and a suitably positioned aperture 36 in the shelf 20, located between the first and second rows of apertures, to attach the mounting bracket A to an upper surface of the shelf. The clip provides another means for securing the plate member 10 to a shelf. In situations where a display shelf does not have suitably positioned apertures for receiving the feet 14 and hooks 16 as well as the clip, the feet and hooks can optionally rest on an upper surface of the shelf 20, and a slightly longer clip is used to secure the plate member 10 to the shelf.

Figure 3:
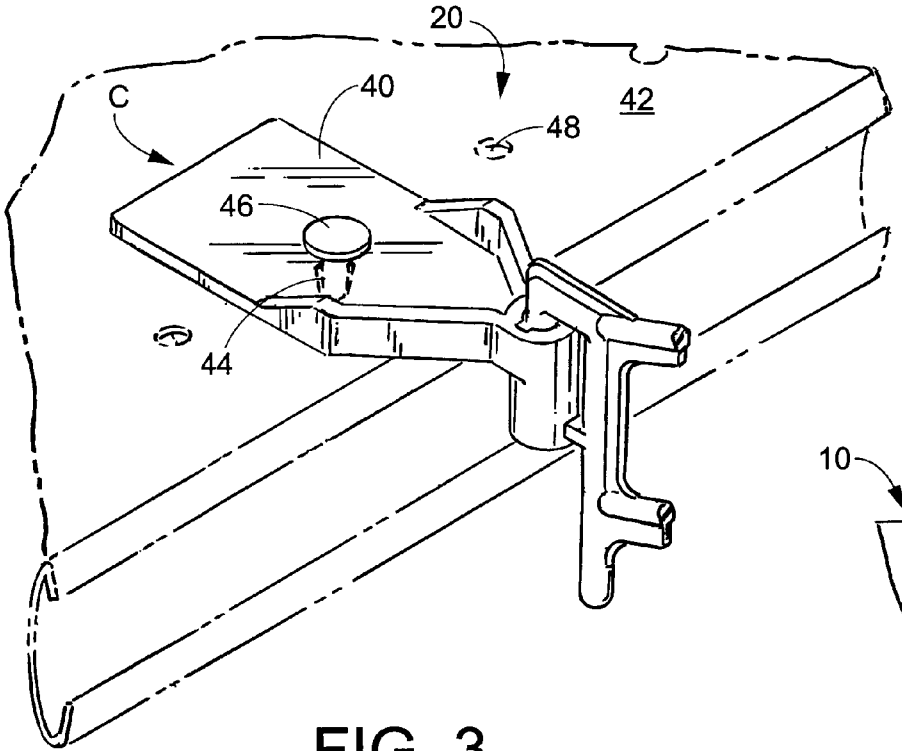
FIG. 3 is a perspective view of a second preferred embodiment of a horizontal mounting bracket of the present invention secured by a clip to a shelf with apertures.

In an alternative embodiment of a horizontal mounting base or bracket C, shown in FIG. 3, a plate member 40 is without feet or hooks. The plate member 40 lies flat on the upper surface 42 of a shelf 20. A vertically extending aperture 44 in the plate member receives a fixing member, such as a clip 46, or other suitable fixing member, for securing the plate member to the shelf. A suitably positioned aperture 48 in the shelf receives the clip therethrough.

With reference once again to FIG. 1, the bracket A (and similarly the bracket C) includes an upright cylindrically-shaped housing or boss 50, molded integrally with the generally V-shaped forward portion 32 of the plate member 10, for releasably attaching the pivotable display member B.

Preferably, the forward portion 32 includes support walls 54 and 56, extending generally vertically from side edges of an upper surface 58 of the forward portion 32 and integrally molded with the boss 50 and the forward portion. The support walls 54 and 56 extend to, and are connected with, an upper end 60 of the boss 50 and provide a rigid connection between the boss and the plate member 10, thereby providing resistance to movement of the boss relative to the plate member 10 and corresponding fracturing of the bracket A.

With continued reference to FIG. 1 and reference also to FIGS. 4, 5, 6, and 7, a vertically extending bore 70 is formed through the boss 50. The bore 70 is configured for snugly receiving a vertically extending connecting member 72 located on a rearward portion of the display member B. The cross section of the bore changes at around a mid point of the length of the bore. Specifically, an upper portion 76 of the bore 40, best shown in FIG. 4, extends from an upper surface 78 of the boss 50. The upper portion 76 has a cross section which includes a circular central region 80 with two opposed key slots 82 laterally extending from the central region. With particular reference to FIG. 1 and reference also to FIG. 8, the key slots 82 are configured for receiving ribs 86 protruding axially from a distal end of the connecting member 72 of the display member B.

A lower portion 90 of the bore 70, best shown in FIG. 7, extends vertically from a lower surface 92 of the boss to meet the upper portion 76 of the bore. The lower portion 90 has a circular cross section with a diameter which is slightly greater than a distance d between outer edges of the key slots 82 of the upper portion 76 of the bore. The two-diameter configuration of the bore provides for releasable locking of the display member B to the mounting bracket A and for pivoting of the display member about a vertical axis though the bore when fully installed, which is perpendicular to the upper and lower surfaces of the mounting bracket, and will be discussed in greater detail below.

Figure 8:
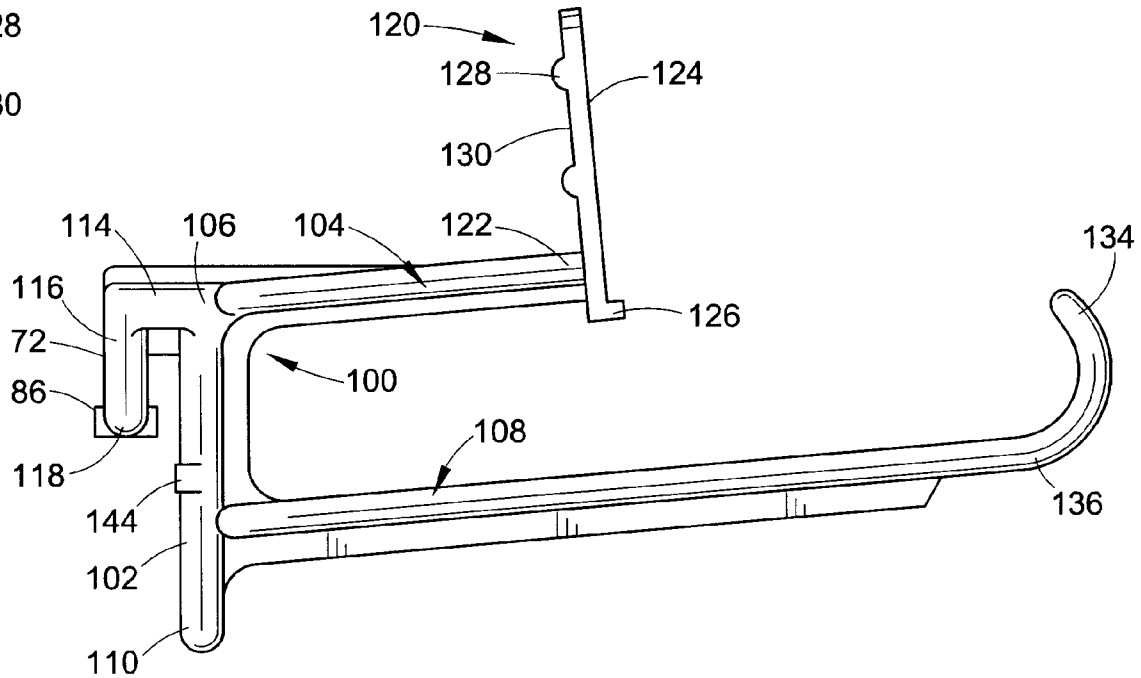
FIG. 8 is a side elevational view of the merchandise hanger and label holder of FIG. 1.
Figure 9:
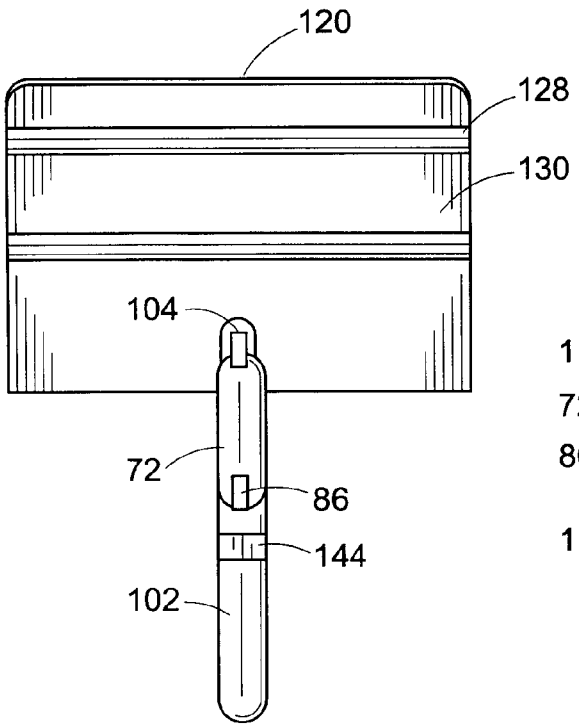
FIG. 9 is a rear elevational view of the merchandise hanger and label holder of FIG. 1.

Turning now to the pivotable display member, FIGS. 1, 8, and 9 show a first embodiment B of the display member. In this embodiment, the display member B serves both to display labels and to hang small items of merchandise. The display member includes a display portion 98 which can take on a variety of configurations. The display portion 98 of embodiment B includes a generally U-shaped hanger 100 which includes a vertical post 102, an upper laterally projecting display arm 104, which extends forwardly from an upper end 106 of the post 102, and a lower laterally projecting display arm 108, which extends forwardly from the post adjacent a lower end 110 of the post. The upper and lower laterally projecting display arms 104,108 are preferably inclined upwardly at a slight angle to the horizontal.

The connecting member 72 is generally L-shaped and extends from the upper end 106 of the post 102. The connecting member includes a horizontal upper arm portion 114, which extends rearwardly from the post upper end 106, and a vertical forearm portion or stem 116, connected at an elbow, which extends downwardly from the upper arm portion. The ribs 86 extend laterally from a lower end 118 of the forearm portion 116 of the connecting member in a direction generally parallel to that of the display arms 104,108. Preferably the U-shaped hanger 100 is integrally molded with the connecting member 72.

A label holder 120 is attached to a forward end 122 of the upper display arm 104. The label holder is configured for receiving display labels which provide pricing and other information about the product displayed on the merchandise and display hanger optionally, the label holder includes a flat label plate 124 on which display labels may be adhesively fixed. A lower lip 126 extends forwardly from a lower edge of the plate 124 as an additional support for a display label. Alternatively, the label holder includes other means of supporting a display label, such as upper and lower channels (not shown) which receive upper and lower edges of the display label or an adhesive surface for adhesively securing a label. Horizontal strengthening ribs 128, best shown in FIG. 9, extend along a rear surface 130 of the plate 124. The label holder may be integrally formed with the rest of the pivotable display member B or adhesively attached, welded or otherwise attached by the rear surface 130 to the end 122 of the upper display arm.

The lower display arm 108, which preferably defines the shape of a hook, is configured for receiving packages of the products to be displayed and may include an upwardly turned tip 134 at a forward end 136 of the lower display arm to inhibit packages from accidentally sliding off the arm. The packages preferably include holes in an upper portion thereof and are slid onto the display arm 108 via the tip 134.

To mount the display member B on the bracket A, the display member is aligned in one of two equivalent mounting positions in which the ribs 86 on the connecting member 72 are positioned over the open key slots 82 of the upper portion 76 of the bore 70. In either of the mounting positions, a longitudinal axis X—X of the display member B is aligned generally parallel with a front edge of the shelf, and generally perpendicular to a longitudinal axis Y—Y through the mounting bracket A. The connecting member 72 is lowered into the boss bore 70 until the ribs 86 enter the lower portion 90 of the bore. An audible click indicates that the connecting member 72 has been properly seated in a pivoting position. As shown in FIG. 7, a shoulder 140 is defined between the upper and lower portions 76,90 of the bore, extending through the boss 50. The click arises because of the resiliency of the plastic from which both the shoulder 140 and ribs 86 are formed, and because the shoulder, which extends around the key slots 82, compresses the ribs slightly. The pivotable display member is then rotated to a position in which the display arms 104 and 108 extend generally outward from the shelf 20.

Figure 10:
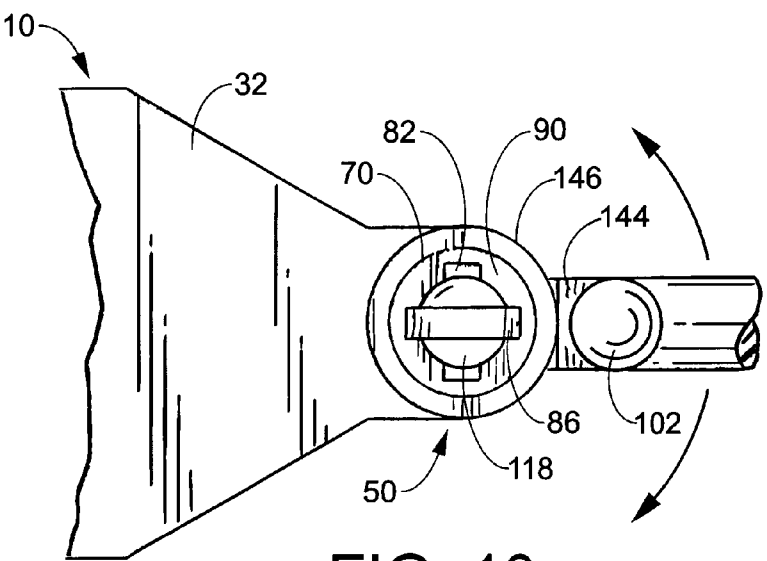
FIG. 10 is a bottom plan view, broken away, of the merchandise hanger and label holder mounting section as secured in a front end of the mounting bracket of FIG. 1.

In the pivoting position, as shown in FIGS. 2 and 10 (i.e., when the display member is fully inserted in the bore), the display member B may be pivoted horizontally via the connecting member 72, about a vertical axis of rotation R which extends through the bore 70. Except in two positions where the ribs 86 of the display member are aligned with the key slots 82 of the upper portion 76 of the bore, the connecting member is prevented from being removed from the bracket A by engagement of the ribs 86 with the shoulder 140. During normal operation, therefore, when the display member B protrudes generally outward from the shelf 20, the display member B is pivotally coupled to the mounting bracket A, and does not tend to be dislodged, for example, by accidental knocking of the display member or when packages are removed from the lower projecting display arm 108. At the same time, the display member B can rotate out of the way when struck by a shopper traveling down a store aisle, thereby preventing injury to the shopper.

With reference to FIGS. 1, 2, 8, and 10, a bearing surface 144 protrudes from a rear portion of the post 102 of the U-shaped hanger 100. As best shown in FIG. 10, the bearing surface 144 slidingly engages an outer surface 146 of the boss 50 for smooth pivotal rotation of the display member and to prevent wobbling of the display member B in relation to the mounting bracket.

Figure 11:
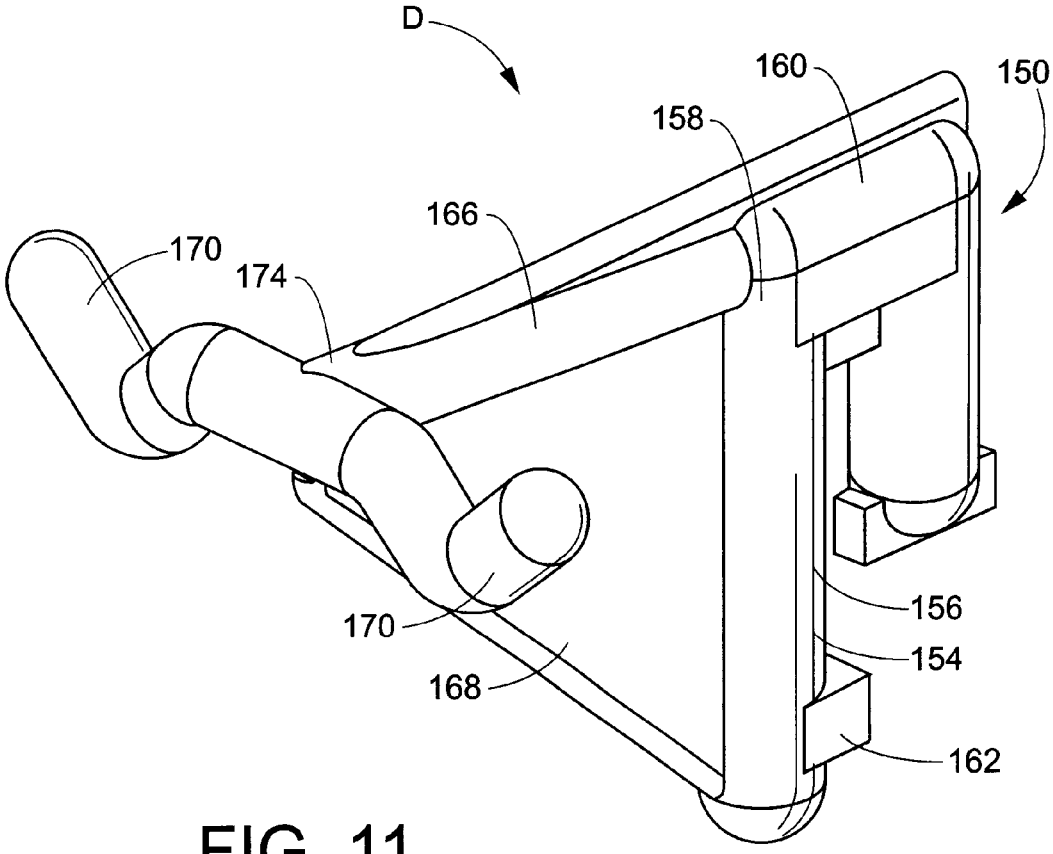
FIG. 11 is a perspective view of a merchandise hanger in accordance with a third preferred embodiment of the present invention.

FIG. 11 shows an alternative embodiment of a pivotable display member D. The display member D is intended for releasable connection with the mounting bracket of any of the embodiments described herein, including the mounting brackets A and C, and is suited to the display of merchandise. The display member D includes an L-shaped connecting member 150, similar to the connecting member 72 of FIG. 1, and a display portion 154. The connecting member 150 extends rearwardly and downwardly from an upper, rearward end of the display portion 154. The connecting member is configured for being received in the bore 70 of the mounting brackets A and C.

The display portion 154 includes a vertical post 156 which is connected at an upper end 158 to an upper arm portion 160 of the connecting member 150. A bearing surface 162 extends rearwardly from a rear surface of the post 156 for slidingly engaging the outer surface 146 of the mounting bracket boss 50. A generally horizontal display arm or mounting arm 166 extends forwardly from the upper end 158 of the vertical post 156 of the display portion 154. The display portion 154 optionally includes a triangular support plate 168 which provides support for the mounting arm 166. The support plate 168 extends forwardly from a front surface of the post 156 and is connected along an upper edge to the mounting arm 166 to stiffen the arm. A pair of package hooks 170 are secured to a lateral arm 172, for receiving packages of products to be displayed. The lateral arm is connected at its midpoint to a forward end 174 of the mounting arm 166 and extends laterally therefrom.

Figure 12:
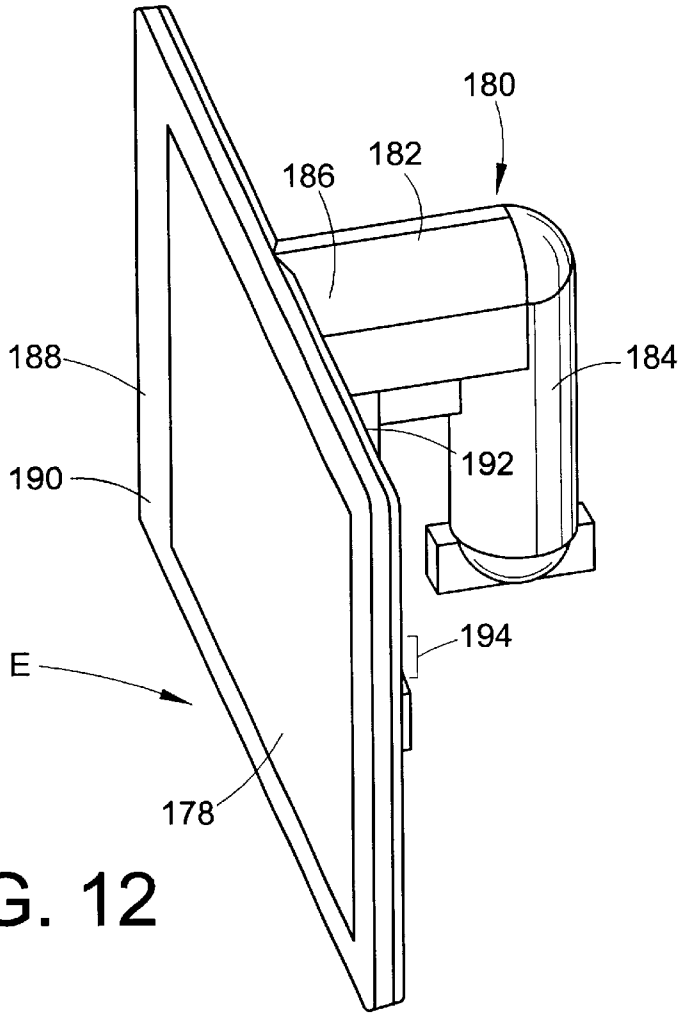
FIG. 12 is a perspective view of a label holder in accordance with a fourth preferred embodiment of the present invention.

The mounting bracket A, C is suited to pivotally supporting a variety of other pivotable display members having the connecting member of FIGS. 1 and 11. FIGS. 12, 13, and 14–15 show three alternate embodiments of a pivotable display member by way of example. FIG. 12 shows a display member E suited to the display of a single label 178. The display member includes a connecting member 180 having an upper arm portion 182 and a forearm portion 184, constructed like the connecting member 72 of FIG. 1. Mounted on the a forward end 186 of the upper arm portion 182, is a single label holder 188. Labels may be adhesively or otherwise affixed to a front face 190 of the label holder. Preferably, a vertical post 192, mounted to a rear surface of the label holder, and extending downward from the forward end 186 of the upper arm portion 182, supports a bearing surface 194, which extends rearwardly from a rear surface of the post. As before, the bearing surface engages an outer surface of the mounting bracket boss 50.

Figure 13:
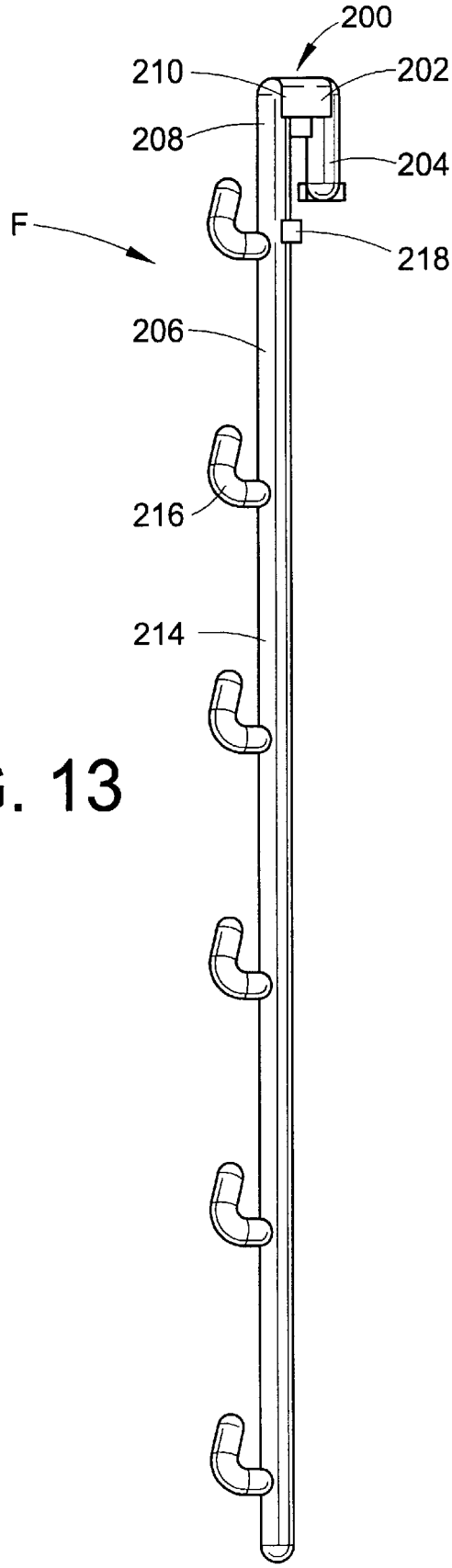
FIG. 13 is a perspective view of a merchandise hanger strip in accordance with a fifth preferred embodiment of the present invention.

With reference to FIG. 13, a pivotable display member F, in the form of a vertically extending merchandiser, is suited to the display of merchandise. The display member F includes a connecting member 200 having an upper arm portion 202 and downwardly extending forearm portion 204, similar to the connecting member 72 of FIG. 1. A display portion 205 includes a downwardly extending display arm 206, which also serves the functions of the post of the embodiment of FIG. 1. The display arm is connected at an upper end 208 to a forward end 210 of the upper arm portion 202. The display arm includes a rod 214 with several vertically spaced hooks 216 protruding therefrom for receiving packages of the products to be displayed. As shown in FIG. 13, the hooks 216 protrude forward from the rod, although other arrangements, such as sideward protruding hooks, are also contemplated. A bearing surface 218 of the type previously described extends rearwardly from an upper portion of the rod 214 for engaging an outer surface of the boss 50.

Figure 14:
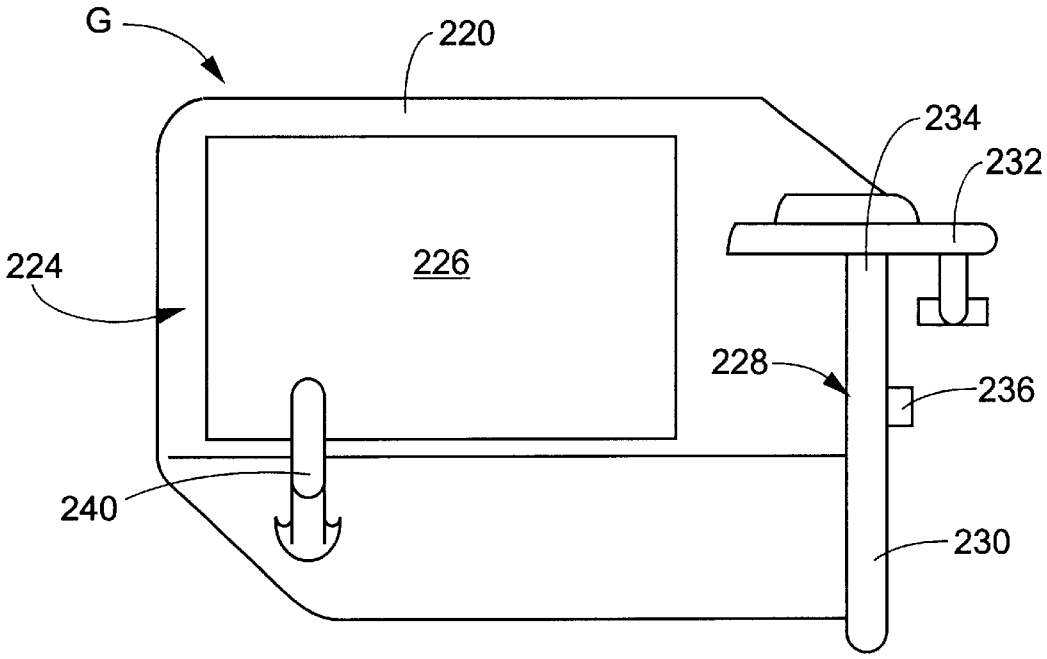
FIG. 14 is a side elevational view of a label holder and merchandise hanger in accordance with a sixth preferred embodiment of the present invention.
Figure 15:
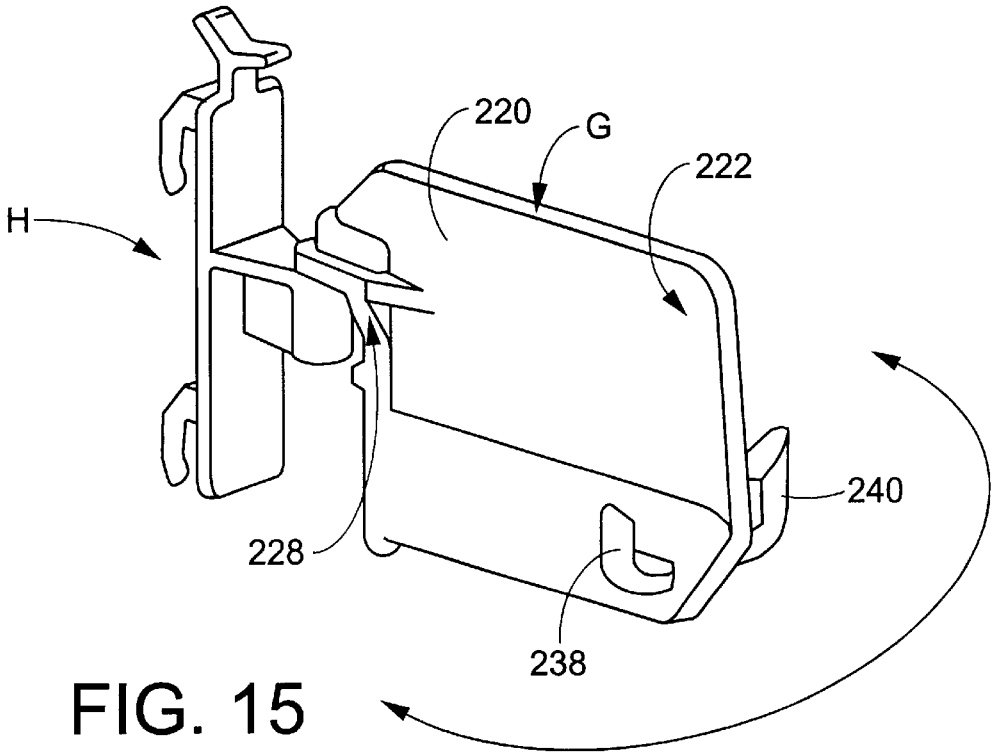
FIG. 15 is a perspective view of the label holder and merchandise hanger of FIG. 14 mounted on a vertical mounting bracket in accordance with a seventh preferred embodiment of the present invention.

With reference to FIGS. 14 and 15 a pivotable display member G is suited to the display of labels and small items of merchandise. The display member G includes a display portion 219, which includes a side facing label holder 220 with left and right facing surfaces 222 and 224 for displaying a label 226 on each side of the label holder. The label holder is attached along a rear vertical edge 228 to a vertically extending post 230. A connecting member 232, similar to the connecting member 72 of the display member B and serving the same purpose, extends rearwardly and downwardly from an upper end 234 of the post 230. A bearing surface 236 extends rearwardly from a rear surface of the post 230. Two mounting hooks 238 and 240 extend outwardly from a lower portion of the left and right facing surfaces 222 and 224, respectively, for receiving small packaged goods.

Figure 16:
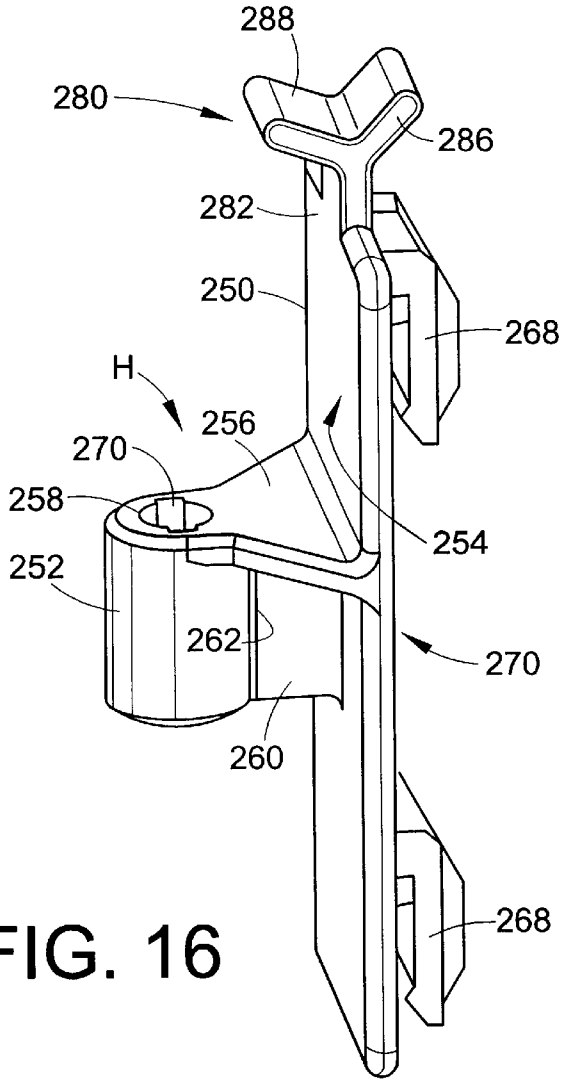
FIG. 16 is a perspective view of the vertical mounting bracket of FIG. 15.
Figure 17:
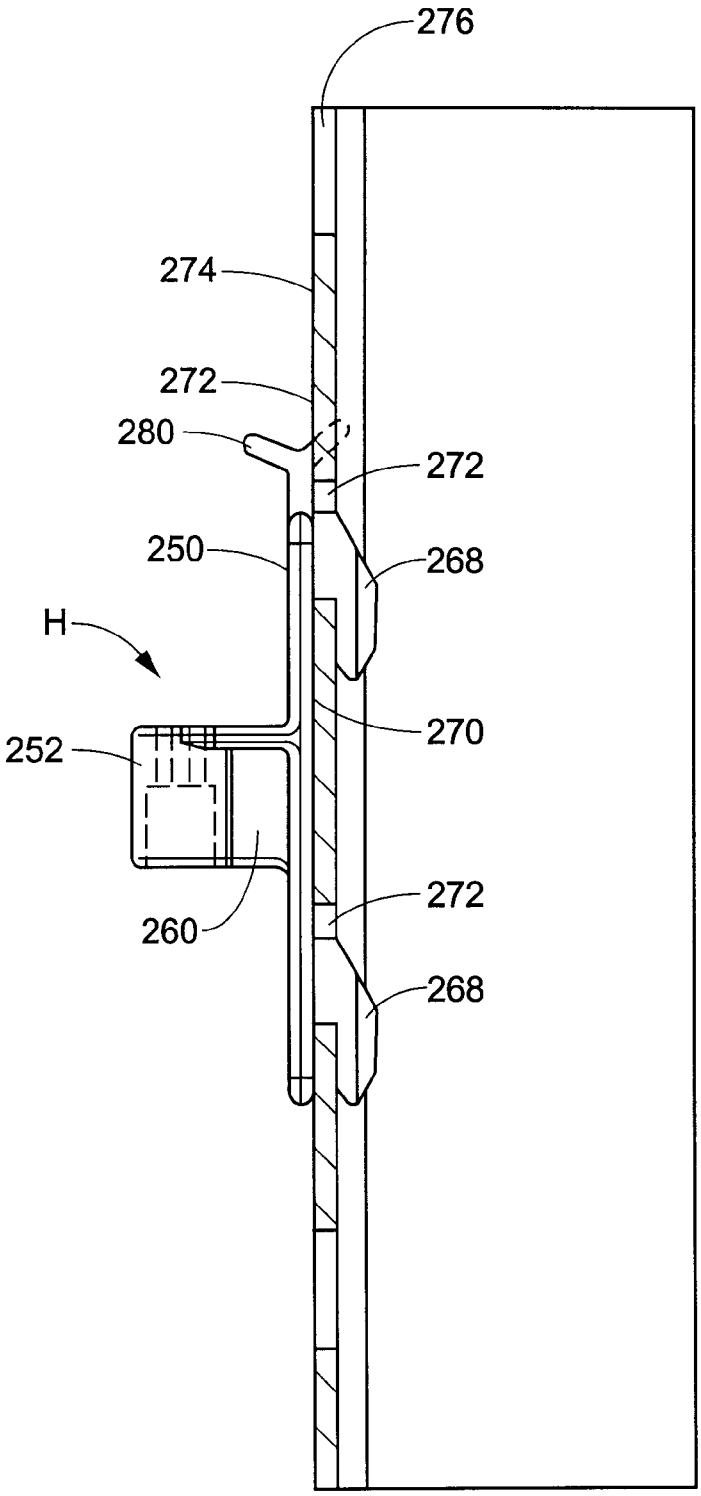
FIG. 17 is a side elevational view of the vertical mounting bracket of FIG. 16 mounted to a vertical support surface.
Figure 18:
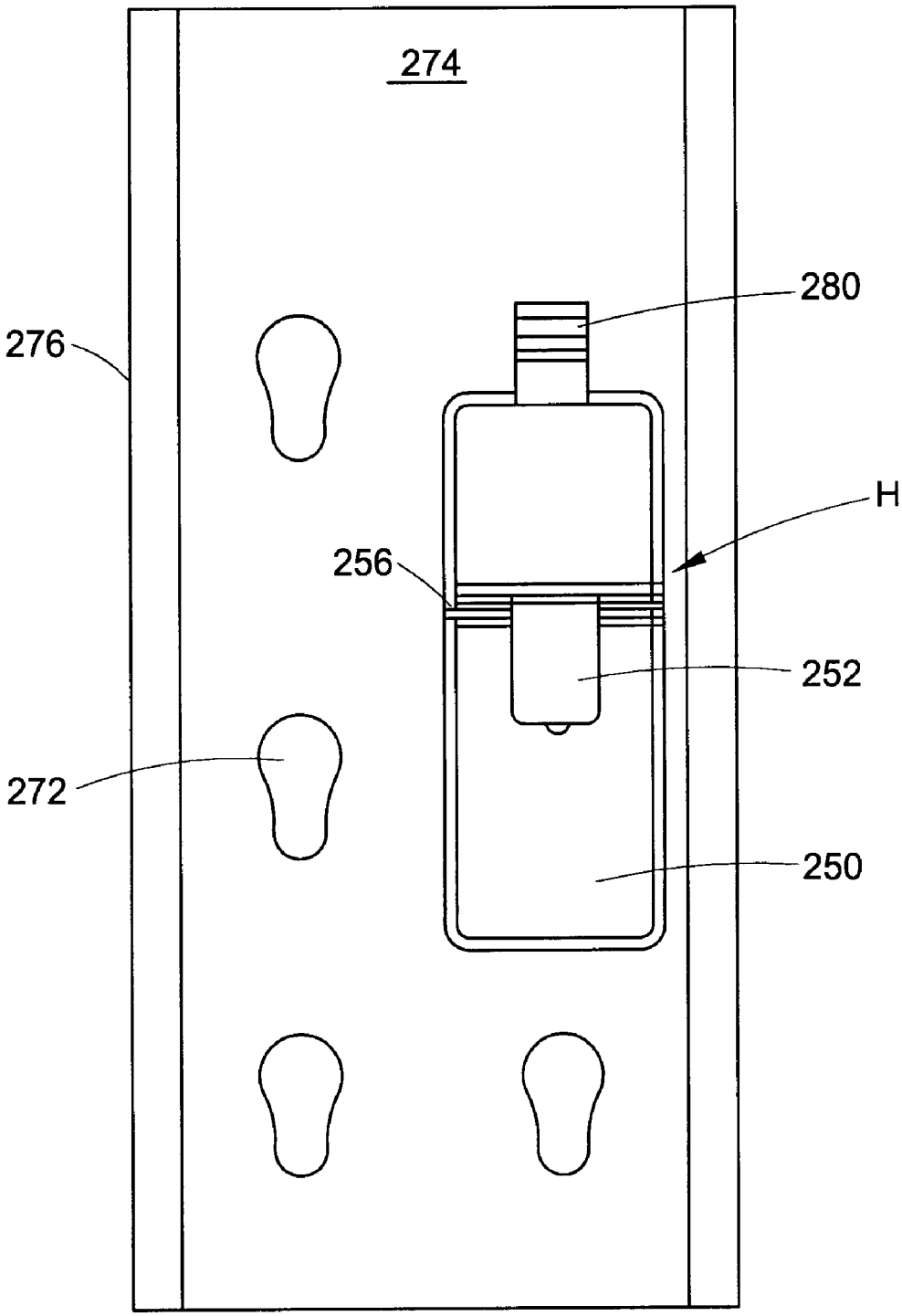
FIG. 18 is a front elevational view of the vertical mounting bracket and the vertical support surface of FIG. 17.

Mounting brackets A and C are configured for attaching to a horizontal surface, such as the upper surface of a shelf. It should be appreciated that by mounting the boss to a vertical plate rather than to a horizontally-extending plate, a mounting bracket suited to mounting on vertical surfaces is obtained. FIGS. 16–18 show an embodiment of an upright mounting bracket H configured for attachment to a front face of a vertical shelf support, or other vertically extending surface. The connecting member of any of the embodiments of the pivotable display member shown herein can be pivotally mounted in the mounting bracket H and still retain their intended orientation. For example, the connecting member 72 of pivotable display member B is used for mounting the display member B to the mounting bracket H. The bracket H includes a vertical extending plate member 250. A cylindrical boss 252, similar to the boss 50 of FIG. 1, is connected to a front face 254 of the plate member 250. In particular, a triangular-shaped, horizontal support wall 256 extends forward from a middle region of the front face 254 and is connected to an upper end 258 of the boss 252. Additionally, a vertical support wall 260 extends forwardly from the front face 254 and is connected at a forward vertical side 262 to a rearward facing surface of the boss and to a lower surface of the horizontal support wall 256. The two support walls 256 and 260 are thus joined to form a somewhat T-shaped construction in cross-section. The two support walls rigidly support the boss 252 and resist twisting of the boss. A bore 266 extends vertically through the boss. The bore is configured in the same manner as the bore 70 of the boss 50 of the embodiment of FIG. 1.

Upper and lower L-shaped fingers 268 protrude from a rear face 270 of the plate member 250 and are adapted for hooking into suitably shaped slots 272 in the front face 274 of an upright support 276 or other suitable support surface. Other means of attachment of the bracket H to a vertical support surface are also contemplated. For example, peg-hooks or mounting fingers configured for attachment of supports to a pegboard could be employed with the mounting bracket H.

As shown in FIG. 16, the upright mounting bracket H preferably includes a Y-shaped stop 280 which extends upwardly from an upper end 282 of the plate member 250. If the plate member is moved upwards during operational use, the stop 280 engages an adjacent upper surface of the upright support slot 272 or other suitable restriction to movement, inhibiting the fingers 268 from being dislodged from their respective slots. A rearwardly extending wing 286 of the Y-shaped stop biases the plate member 250 forwardly by pressing on an adjacent portion of the vertical support surface. This brings the fingers 268 into frictional engagement with the wall material adjacent the slots of the vertical support to which the bracket H is mounted. This feature retards unintended removal of the bracket from the vertical support. Preferably, the stop 280 is resiliently flexible so that it deflects slightly, if needed, during installation of the mounting bracket to allow engagement of the fingers 268 with the slots. A Y-shaped cross section for the stop 280, with a forward facing wing 288 can be conveniently used, although a stop without a forward facing wing is also contemplated.

Figure 19:
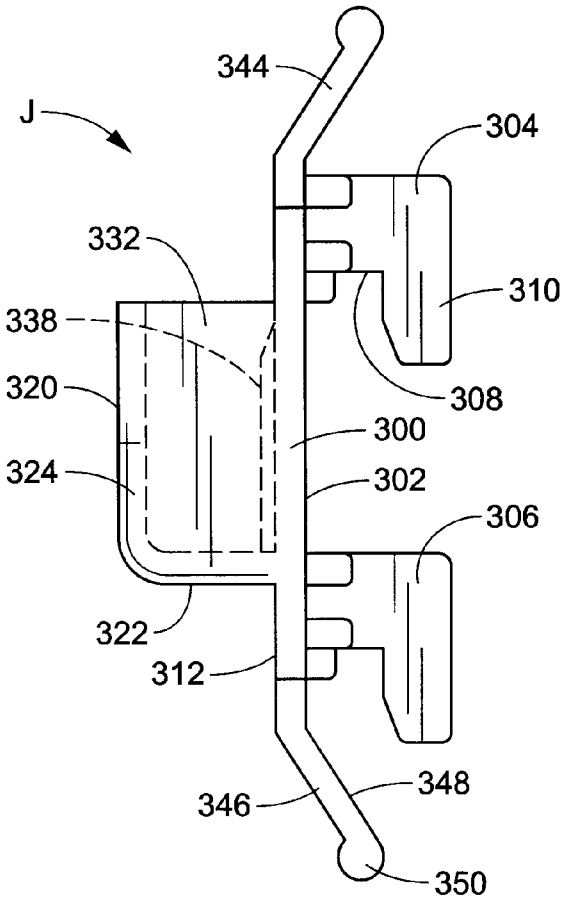
FIG. 19 is a side elevational view of a sign support mount for a non-pivotable display system according to an eighth preferred embodiment of the present invention.
Figure 20:
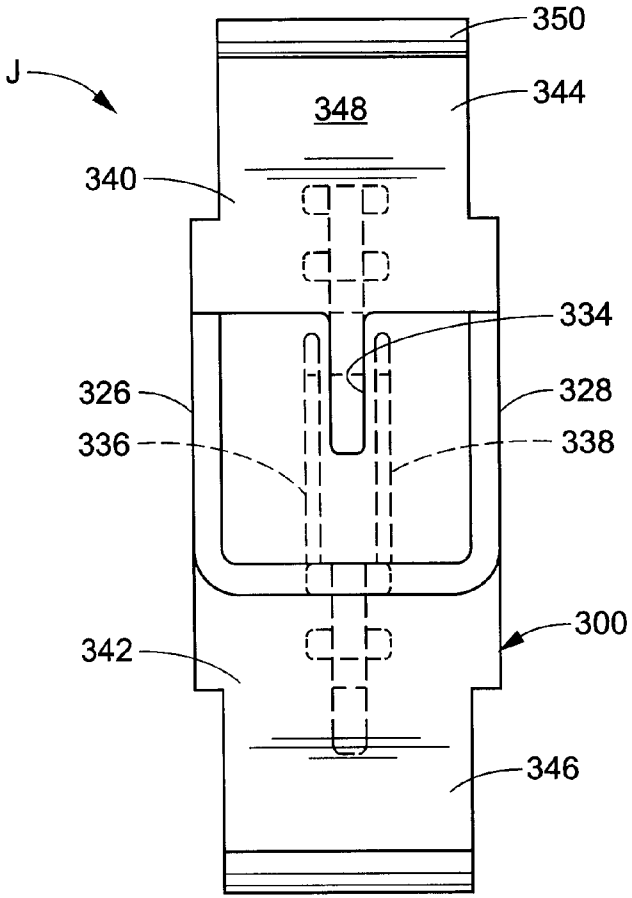
FIG. 20 is a front elevational view of the mount of FIG. 19.

FIGS. 19–26 show various embodiments of a multicomponent rigid, or non-pivotable interchangeable display system 290. With reference to FIGS. 19 and 20, in a preferred embodiment, the non-pivotable display system 290 includes a vertical mounting bracket or upright mount J for use with a non pivotable display member. Like the vertical bracket H, the vertical mounting bracket J is suited to mounting on a vertical support surface, such as the support surface 276 shown in FIG. 17. It should be appreciated however, that a horizontal mounting bracket is also contemplated, for mounting to a horizontal support surface, such as shelf 20. The mount J comprises a support body 300. As shown in FIG. 19, extending from a rear surface 302 of the support body are spaced first and L-shaped second fingers 304 and 306. Each of these fingers includes a first section 308 which projects approximately normal to a plane of the support body 300 and a second section 310 which is oriented approximately normal to the first section 308 and approximately parallel to the plane of the support body 300. Extending from a front wall 312 of the support body 300 is a housing 320. The housing comprises a bottom wall 322, a front wall 324 and first and second side walls 326 and 328 (FIG. 20). Together, the several walls and the adjacent support body define a socket 332. With reference again to FIG. 18, a slot 334 is defined in the front wall 324. Extending into the socket 332 are a pair of spaced ribs 336 and 338. These ribs project forwardly from the front wall 312 of the support body 300.

The support body has an upper end 340 and a lower end 342. Extending from the upper end and lower ends, respectively, are first and second wings 344 and 346. These wings include a substantially planar body 348 and, located on a distal end thereof, a rounded protrusion 350. As is evident from FIG. 17, the wings extend rearwardly at an obtuse angle to the plane of the support body 300.

Figure 21:
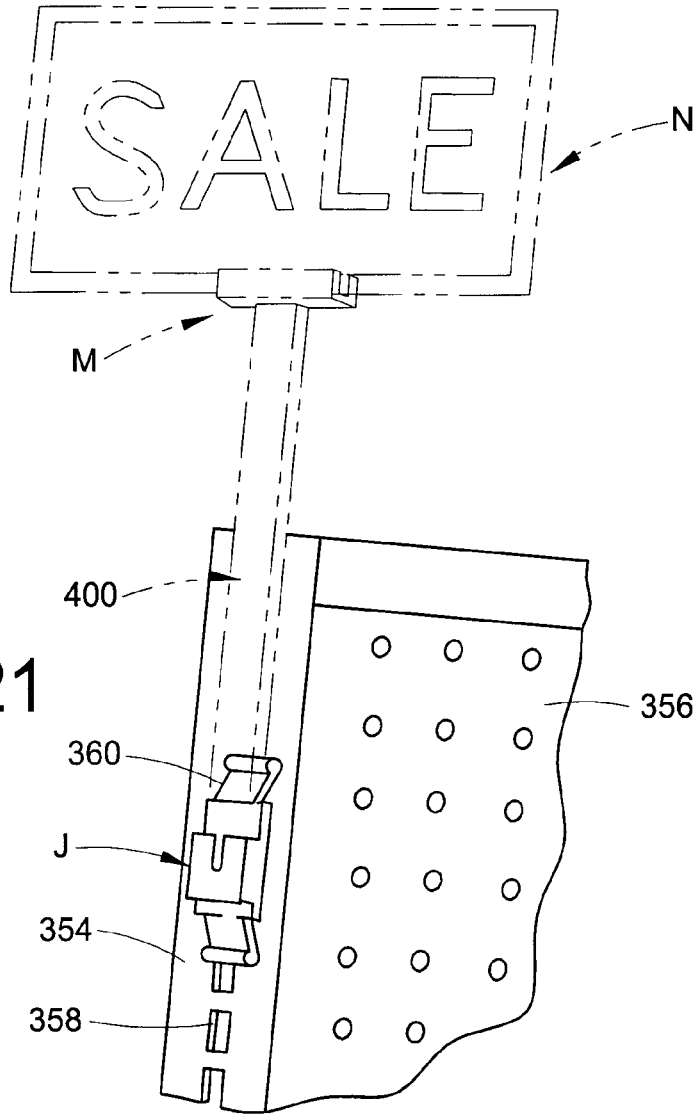
FIG. 21 is a perspective view of the mount of FIG. 19 being connected to a slotted post and supporting a rail, a sign adapter, and a sign.

With reference now to FIG. 21, the upright mount J is shown as being secured in a vertically extending reinforcing member 354 located along one side edge of a pegboard 356. The pair of spaced finger 304 and 306 of the upright mount J protrude into vertically spaced slots 358 in the reinforcing member 354. It is apparent from FIG. 23 that the wings 344 and 346 bias the support body 300 forwardly so as to insure that the first and second fingers 304 and 306 are held tightly in the slots 358 of the reinforcing member 354. This design of the upright mount J prevents inadvertent dislodgement of the upright mount from the reinforcing member 354. Supported in the socket 332 of the housing 320 is a bottom end 360 of a non-pivotable display member K.

Figure 22:
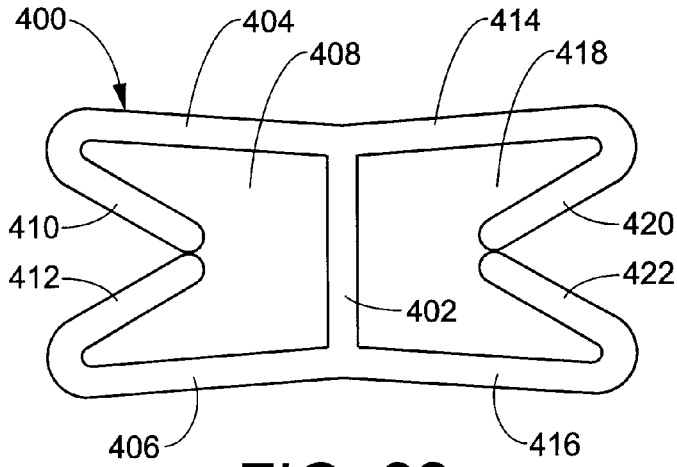
FIG. 22 is a top plan view of the rail of FIG. 21.

With reference now to FIG. 22, one form of a display member K comprises a rail 400. The rail includes a base wall 402. A first side wall 404 and a second side wall 406 extend away from the base in a first direction. The first and second side walls are substantially parallel to each other. A first channel 408 is defined between the first and second side walls 404 and 406 and the base wall 402. A respective lip 410, 412 extends into the first channel 408 from a distal end of each of the side walls 404 and 406 such that the lips contact each other. The lips can thus frictionally engage opposed sides of a sign such as the sign L illustrated in FIG. 25. Extending away from the base 402 in a second direction are third and fourth side walls 414 and 416. It can be seen that the third and fourth side walls 414 and 416 are substantially parallel to the first and second side walls 404 and 406. The third and fourth side walls 414 and 416, together with the base wall 402 define between them, a second channel 418. Extending into the channel from the distal ends of the third and fourth side walls are respective lips 420 and 422, which can contact each other. A sign can be inserted into the second channel 418 between the lips and be gripped thereby. The rail 400 is made from a suitable conventional resilient material, such as a thermoplastic, for example, an extruded clear polyvinyl chloride, the lips can flex away from each other to allow the insertion and removal of the sign L. The flexibility of the lips allows them to accommodate signs of varying thickness.

The rail 400 is advantageous from the standpoint that it can hold signs on either side. It is apparent that the construction of the rail 400 is such as to allow either set of lips 410, 412 or 420, 422 to grasp a side edge of the sign L. Since the rail is preferably transparent, the sign held can be fully seen.

Figure 25:
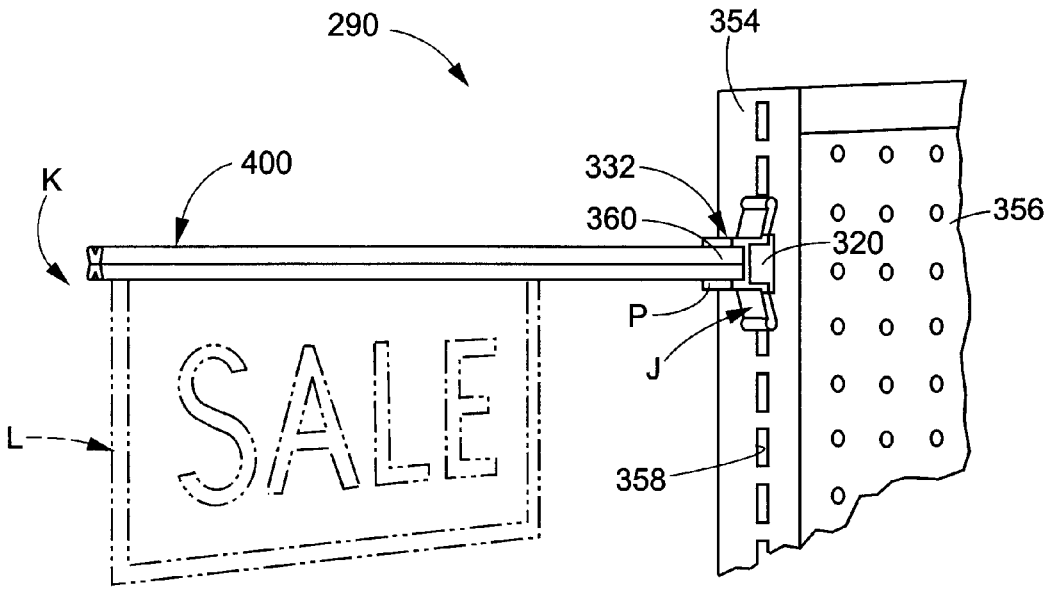
FIG. 25 is a perspective view of the mount of FIG. 19, a flag adapter, and the rail of FIG. 22, according to the present invention.

The rail 400 may be inserted in the socket 320 of the upright mount J in a vertical orientation, as shown in FIG. 21, or may be mounted in a horizontal orientation with the aid of a flag adapter, as shown in FIG. 25 and described in further detail below.

Figure 23:
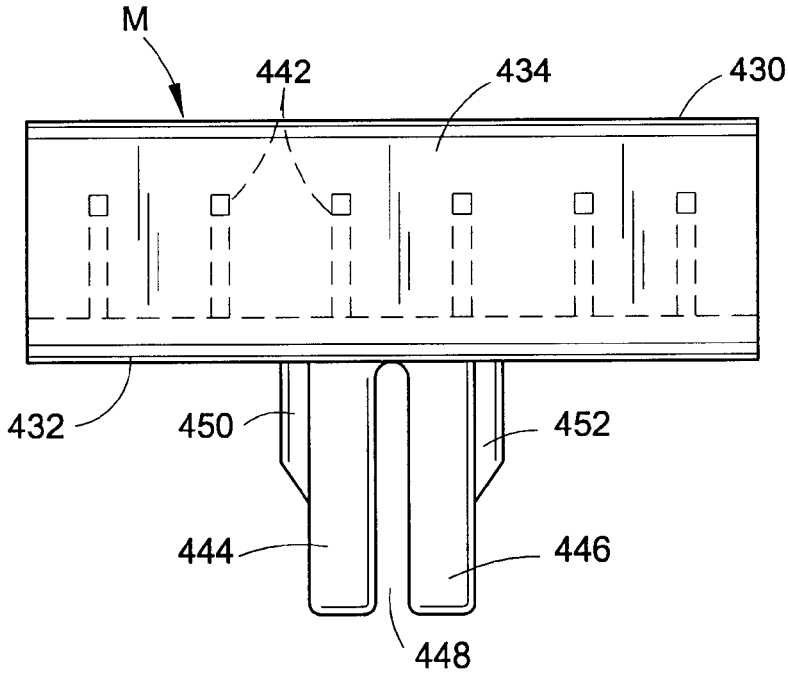
FIG. 23 is a front elevational view of the sign adapter of FIG. 21 which can be supported in the rail of FIG. 22.
Figure 24:
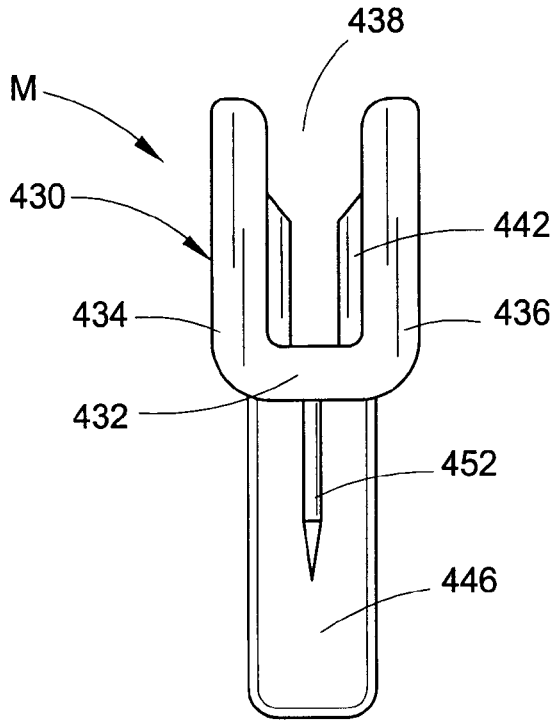
FIG. 24 is a side elevational view of the sign adapter of FIG. 23.

With reference now to FIGS. 23 and 24, mounted in a top end of the rail 400 is a sign adapter M which holds a suitable conventional sign N. The sign adapter M comprises a body 430 having a horizontally oriented base wall 432 and a pair of vertically oriented spaced side walls 434 and 436. With particular reference to FIG. 24, a first side wall 434 extends substantially perpendicularly from one side edge of the base wall 432 and a second side wall 436 extends substantially perpendicularly from an opposed side edge of the base wall 432. A channel 438 is defined between the base wall 432 and the pair of side walls 434 and 436.

Extending into the channel 438 from an inner surface of each of the first and second side walls 434 and 436 are a series of space ribs 442. The ribs serve to reduce the width of the channel when approaching the base wall 432 as is evident from FIG. 24. Reducing the channel width is advantageous from the standpoint that it allows the holding of a suitable sign N which may be inserted into the sign adapter M more firmly.

Projecting from the base wall 432 in a direction opposite to the orientation direction of the first and second side walls 434 and 436 are first and second mounting legs 444 and 446. The two mounting legs are spaced apart by a slot 448 defined between them. A first wing 450 is located on an outboard side of the first mounting leg 444 and a second wing 452 is located on an outboard side of the second mounting leg 446, as may be evident from FIG. 23. The first and second mounting legs 444 and 446 are adapted to extend into the first and second channels 408 and 418 in the rail 400 illustrated in FIG. 22. The wings 450 and 452 are trapped between the pairs of lips 410, 412, 420 and 422 of the rail 400 and serve to prevent the sign adapter from falling out of the rail.

Figure 26:
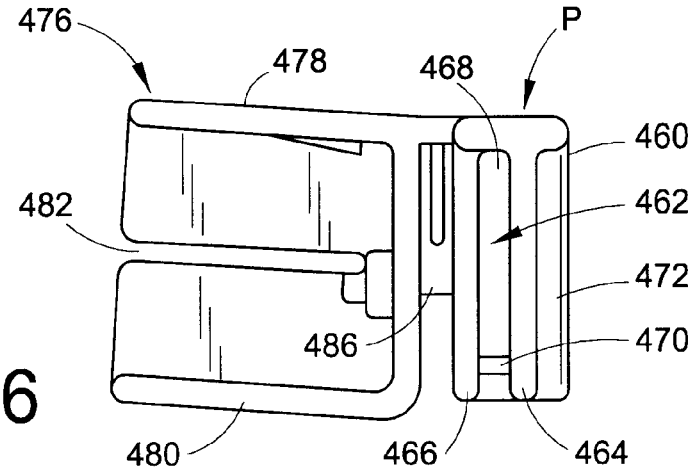
FIG. 26 is a front elevational view of the flag adapter of FIG. 25 which can be employed in the mount of FIG. 19.

With reference now to FIG. 26, a flag adapter P is there illustrated. The flag adapter comprises a body 460 having a mounting portion 462. The mounting portion includes a T-shaped section 464 and a rib 466. These two elements are secured together by a connecting wall 468 and a brace section 470. Another wall section 472 projects rearwardly from the T-shaped section 464. A flag supporting portion 476 is also provided on the body 460. The flag supporting portion includes a first leg 478 and a second leg 480. The two legs are spaced from each other along a slot 482. It is apparent from FIG. 26 that while the T-shaped section 464 of the mounting portion 462 is approximately vertically oriented, the first and second legs 478 and 480 of the flag supporting portion 476 are approximately horizontally oriented. A connecting wall 486 secures the flag supporting portion 476 to the mounting portion 462.

With reference to FIG. 25, the upright mount J is shown as being secured in the reinforcing member 354 and the flag adapter P is shown as being suspended in the socket of the upright mount. To this end, the flag adapter mounting portion 462 is inserted into the socket 332 of the mount J and the pair of legs 478 and 480 protrude forwardly of the mount. It should be appreciated that the connecting wall 486 of the flag adapter P is meant to extend through the slot 334 in the front wall 324 of the support body 300 of the upright mount G. A rail 400 has a first end accommodating the pair of spaced legs 478 and 480 of the flag adapter P. A suitable conventional sign M can be held in a second end of the rail in a flag or in a banner-like manner.

From the foregoing, it should be readily appreciated that the non-pivotable display system shown in FIG. 25 could take the form of a pivotable display system. To do this, a flag adapter similar to flag adapter P is provided, but with a pivotable connecting member similar to the connecting member 72 of FIG. 1 instead of the T-shaped section 464, connecting wall 468, and brace section 470 of the mounting potion 462 of flag adapter P. The connecting member is inserted into the boss 50 or 252 of horizontal and vertical mounting brackets A or H, respectively, rather than in the socket 332 of mount J. In this embodiment, the flag adapter, rail 400 and sign L pivot about an axis through the respective bore 70, 270 of the boss.

With reference now to FIGS. 27–31, another embodiment of a display system 500 includes a vertical mounting bracket or upright mount R for use with a display member 504. Like the vertical bracket H, the vertical mounting bracket R is suited to mounting on a vertical support surface, such as the upright support 276 shown in FIG. 17. It should be appreciated however, that a horizontal mounting bracket is also contemplated, for mounting to a horizontal support surface, such as shelf 20. The terms "upper," "lower," "rearward," and "forward" and the like are used with respect to the orientation shown in FIG. 27.

Figure 29:
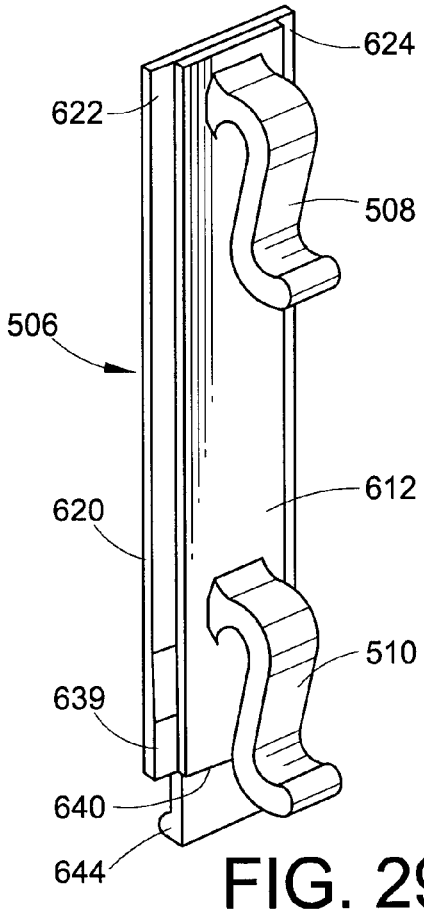
FIG. 29 is a perspective view of the bracket of FIG. 27.

As shown in FIG. 29, the mount R comprises a rectangular, generally planar support body 506. Spaced first and second hook-shaped fingers 508 and 510 extend rearwardly and downwardly from a rear surface 612 of the support body for entering corresponding slots 614 (FIG. 27) in the upright support 276. Once inserted, the fingers grip the material of the upright support between the fingers and the rear surface of the support body. Other mounting members are also contemplated. For example, the fingers 508, 510 may be replaced with a layer of adhesive for adhesively attaching the rear surface 612 to a suitable support body. The adhesive may be of the releasable type, to allow the mount R to be removed and/or if repositioned if desired. The adhesive may be covered with a release layer prior to use. Or, fingers analogous to fingers 14, 16, shown in FIGS. 1 and 2, or a fastener, analogous to screw 46, as shown in FIG. 3, may be used. It will be appreciated that the orientation of the various components will change accordingly if the display system is used, for example, on a horizontal shelf.

Figure 28:
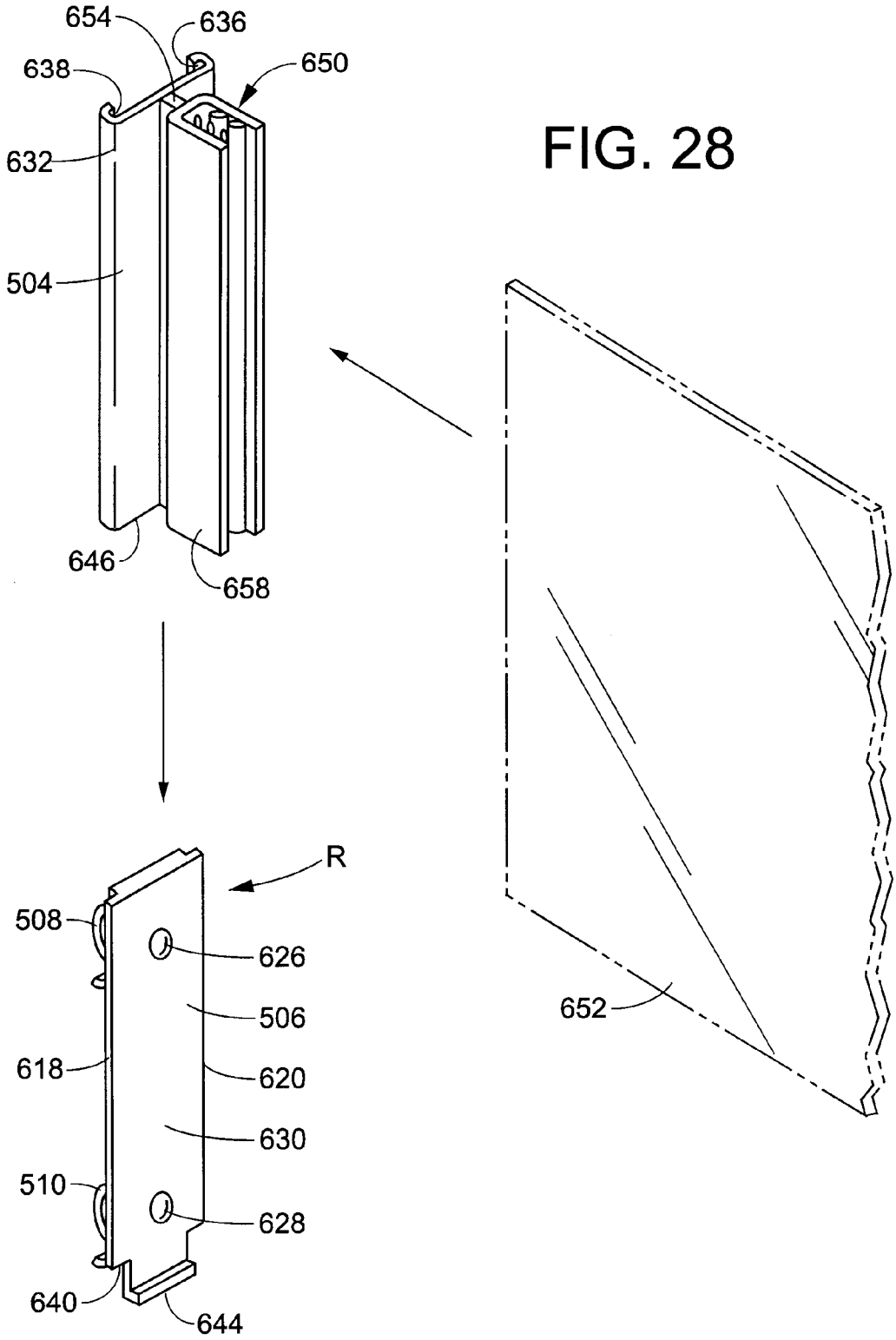
FIG. 28 is an exploded perspective view of the support bracket, display system, and flag of FIG. 27.

Vertical edges 618, 620 of the support body are cut away along their length to define a pair of spaced, parallel grooves 622, 624 on either side of the rear surface of the support body. With reference now also to FIG. 28, two spaced apart protrusions 626, 628 extend forwardly of a front, planar surface 630 of the support body. The protrusions are preferably generally hemispherical in shape, although other shapes are also contemplated.

Figure 31:
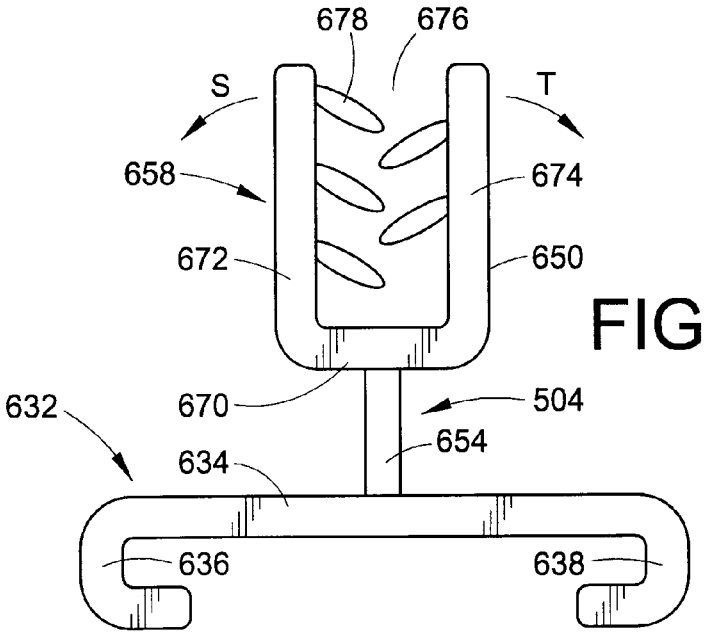
FIG. 31 is an enlarged top plan view of the display member of FIG. 27.

With reference now to FIG. 31, the display member 504 includes a proximal or engagement portion 632 which is shaped to releasably and frictionally engage the support body 506. Specifically, the engagement portion includes a generally planar forward wall 634 with two opposed rearwardly extending U-shaped flanges 636, 638, which each define a channel to receive the cut away sides 618, 620, respectively, of the support body therein.

To assemble the display member 504 and mount R, the display member is positioned above the mount, as shown in FIG. 28, and slid downward over the mount, the flanges slidingly contacting the grooves of the support body. This operation is preferably carried out before mounting the mount R on the support surface, although it can be done afterwards. The grooves 622, 624 can have tapered, lower ends 639 adjacent the lower end 640 of the support body, so that the sides 618, 620 of the support body increase in width towards the bottom, creating an increasing frictional engagement between the flanges and the support body. The momentum developed in sliding the display member downwards onto the mount allows the user to overcome this friction force and complete the installation of the display member. However, once installed, the force needed to begin sliding the display member upwards is relatively large, resisting accidental removal. Additionally, the two projections 626, 628 on the front of the support body provide an outward force on the forward portion, such that by the time the display member has reached a lower end 640 of the support body, the display member is gripping the support body sufficiently firmly to resist displacement of the display portion if knocked from below.

Figure 30:
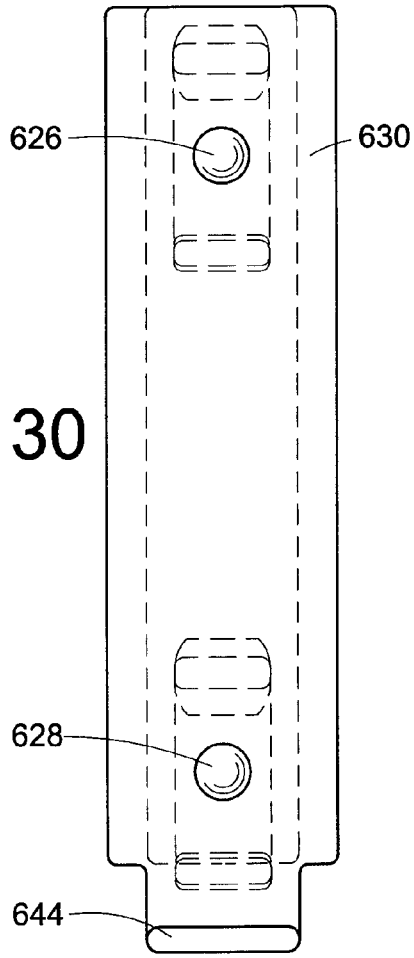
FIG. 30 is a front elevational view of the bracket of FIG. 27.

As shown in FIG. 30, a shelf 644 extends forwardly of the lower end 640 of the support body. A lower end 646 of the engagement portion of the display member rests on the shelf when the display member is fully inserted. The shelf serves to prevent the display member from sliding off the bottom of the mount.

The display member and support body are preferably configured such that the force required to remove the display member from the mount is substantially greater than the force required to remove the mount from the support slots 614. This facilitates removal of the display system from the shelf support 276 and repositioning by gripping the display member 504.

The display member 504 further includes a display or distal portion, such as a sign holding portion 650, for holding a sign or flag 652 (FIG. 28). The sign holding portion extends forwardly of the forward wall 634 of the engagement portion and is connected thereto by a hinge 654. As shown in FIG. 31, the hinge preferably comprises a strip of material which connects the forward wall of the engagement portion 632 and the sign holding portion 650. The hinge 654 is resiliently flexible, allowing the sign holding portion 650 to flex or pivot in use, relative to the engagement portion, when a force is applied, for example, when a shopper knocks the sign. This causes a force to build up in the hinge. The material from which the hinge is made has a memory. Thus, once the applied force is removed, the hinge 654 flexes back and returns to its original position-generally perpendicular to the front portion 634 of the engagement portion.

The sign holding portion 650 of the display member releasably and frictionally holds the sign 652, which may be a sheet of plastic, card, paper, or the like. The sign displays information about the products on the shelves, such as price. The sign holding portion may comprise a U-shaped channel 658, connected to the hinge by a central wall 670, thereof. Two side walls 672, 674 extend forwardly from the central wall 670 to define the U-shaped channel 658 for receiving the sign. The U-shaped channel has an inlet end 676 opposite the central wall 670. The longest dimension of the channel is generally parallel to and generally coextensive with the longest dimension of the hinge portion (i.e., with hinge and channel longest dimensions are both vertically oriented).

Thus, the hinge flexes readily in directions S and T when a force is applied to one or other of the faces of the sign. For sign holders which are to be used on upper or lower shelves, it may be desirable to angle the sign towards the shopper's view. In such cases, the hinge may be aligned at an angle to the largest dimension of the front wall 634. The hinge is preferably wide enough to allow the sign holding portion to pivot to a position in which the sign is relatively flush with the shelf support. For example, in the embodiment of FIGS. 27–31, the sign could be pivoted by about 30–45° from its normal rest position when the sign holding portion 650 is pivoted towards the shelf to its maximum extent.

Resiliently flexible fins 678 extend into the channel 676 from each of the side walls 672, 674 to frictionally engage opposite sides of the sign 652. Preferably, the fins are oriented such that their distal tips point rearwardly. As shown in FIG. 31, the fins attached to one side wall are interdigitated with those on the other wall (the tips slightly overlapping), although other arrangements are contemplated. The fins flex rearwardly to allow the sign to be inserted but resist removal of the sign by gripping it when an attempt is made to pull the sign outwardly.

Alternatively, the sign holding member may be formed similarly to the rail 400 shown in FIG. 22, with two lips similar to lips 410, 412 extending into the channel 676 from a distal end of each of the side walls 672, 674 such that the lips contact each other. The lips can thus frictionally engage opposed sides of the sign.

The display member may be integrally formed from suitable thermoplastic materials by coextrusion or by other known manufacturing methods. A clear flexibly resilient material is particularly preferred. More preferably, the fins and hinge can be made from a resiliently flexible material, such as a urethane (e.g., Pellethane™, obtained from Dow Plastics), while the remaining portions of the display member can be formed from a less flexible, relatively rigid material, such as a polyvinyl chloride (PVC). The mount may be formed from a relatively rigid plastic.

Figure 32:
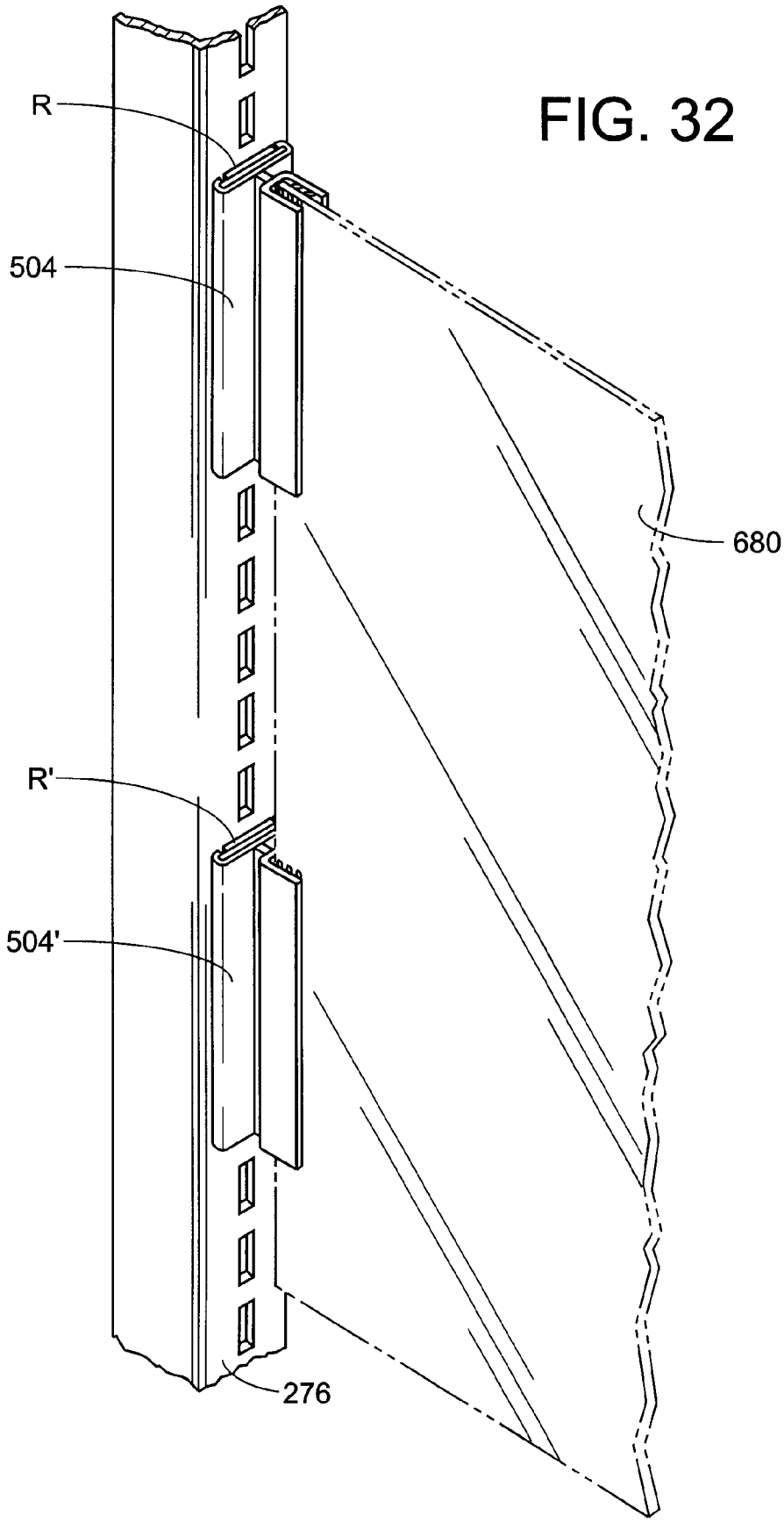
FIG. 32 is a perspective view of a pair of the support brackets and display systems of FIG. 27 holding a flag.

With reference now to FIG. 32, the display system 500 can be used to support elongated signs and other larger items, for example, a large sign 680, by using more than one display member 504 and mount R. FIG. 32 shows two spaced apart mounts R and R', one positioned below the other, each with its own display member, 504, 504'. If the sign 680 is knocked, both display members can flex as needed, reducing any stress on the sign.

Figure 27:
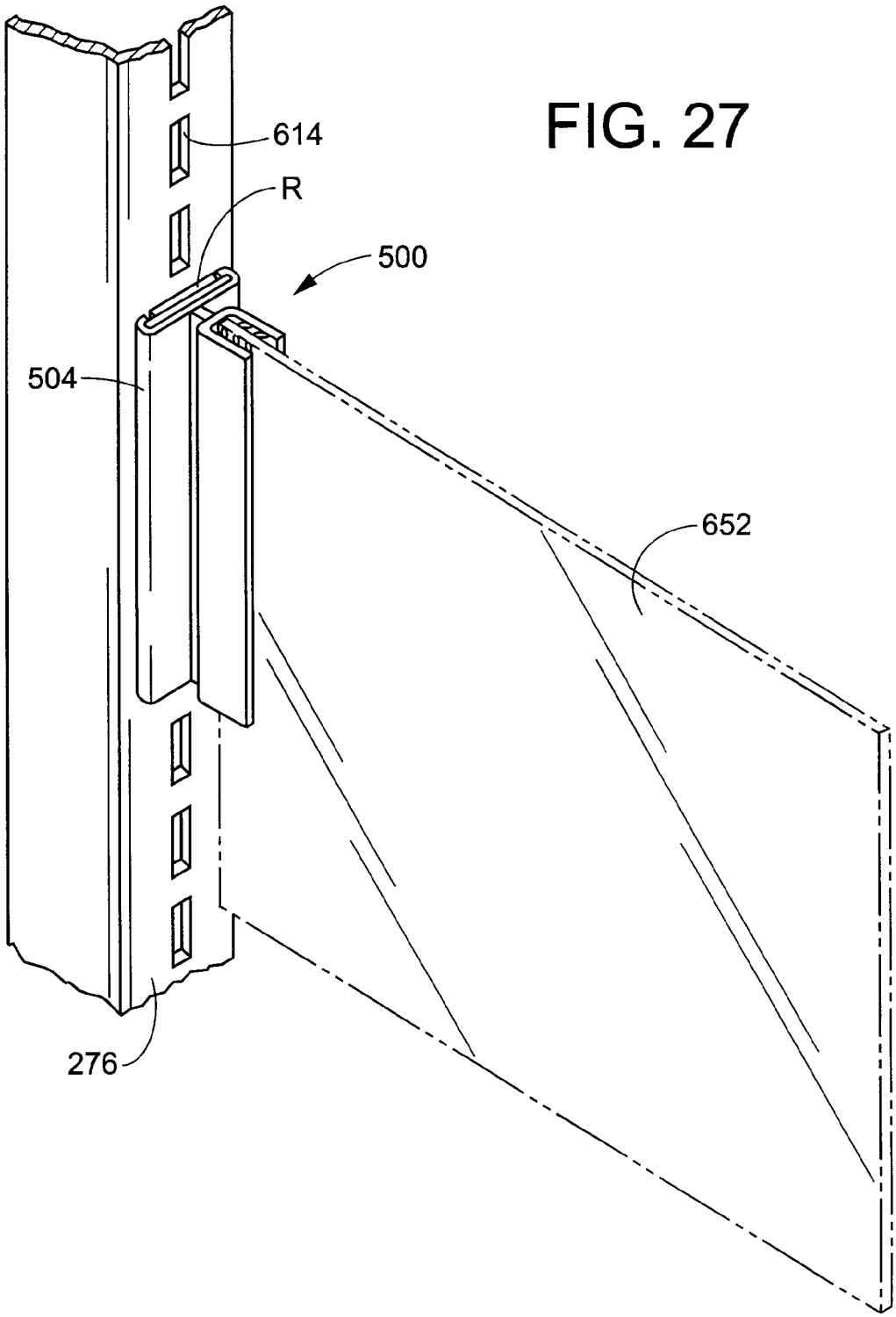
FIG. 27 is a perspective view of a support bracket and a display system holding a flag according to a ninth preferred embodiment of the present invention.

It will be appreciated that the hinged display member 504 can take on other forms than that shown in FIGS. 27–28 and 31. For example, the sign holding portion 650 may be replaced by a distal portion similar to the pivotable display member G illustrated in FIG. 15. In this embodiment, the hinge 654 and 634 would replace the post 230 and connecting member 232 of FIG. 14, the label holder 220 being attached directly to the hinge portion. The display member may support package hooks for displaying small items, analogous to hooks 238, 240.

The invention has been described with reference to the preferred embodiments. It should be apparent that modifications and alterations will occur to others upon a reading and understanding of the preceding specification. It is intended that the invention be construed as including all such alterations and modifications insofar as they come within the scope of the appended claims or the equivalents thereof.

Having thus described the preferred embodiments, the invention is now claimed to be:

1. A display system comprising:

a generally planar support body including a first surface defining a groove and a second surface;

a mounting member extending from the first surface of the support body, the mounting member selectively engaging an associated fixture;

a display member selectively connectable with the support body, the display member including:

a generally planar portion, a flange extending from a side of the generally planar portion, said flange selectively slidably engaging said groove when said display member is connected with the support body, and a hinge portion which allows the display member to pivot in relation to the support body when a force is applied to the display member.

2. The display system of claim 1, wherein the mounting member includes spaced fingers extending away from the support body for engaging suitably shaped and positioned openings in the associated fixture.

3. A display system comprising:

a generally planar support body, the support body including a front surface and a rear surface;

a mounting member extending from the rear surface of the support body, the mounting member selectively engaging an associated fixture;

a display member selectively connectable with the support body and having opposed planar surfaces, a hinge extending from a first of the opposed planar surfaces;

a projection extending from the front surface of the support body, which frictionally engages the other of the opposed planar surfaces of the display member when the display member is received on the support member.

4. The display system of claim 3, wherein the display member in includes a planar portion and two flanges, which extend from the planar portion, the flanges cooperating with the planar portion to grip the support body therebetween.

5. A display system comprising:

a generally planar support body;

a mounting member extending from a first surface of the support body, the mounting member selectively engaging an associated fixture;

a shelf extending from a second surface of the support body;

a display member selectively connectable with the support body, the display member including an engagement portion including a flange for selectively engaging the planar support body, a hinge portion, connected therewith, and a sign holding portion connected with the hinge portion for selectively holding an associated sign, the hinge portion flexing, relative to the engagement portion, when a force is applied to the display member, said shelf contacting a generally planar portion of the associated display member when the display member is received on the support member, the generally planar portion of the display member being connected with the flange.

6. A display system comprising:

a generally planar support body including a projection extending from a surface thereof;

a mounting member extending from a surface of the support body, the mounting member selectively engaging an associated fixture;

a display member selectively connectable with the support body, the display member including an engagement portion including a flange for selectively engaging the planar support body, a planar portion, a hinge portion, connected therewith, and a sign holding portion connected with the hinge portion for selectively holding an associated sign, the hinge portion flexing, relative to the engagement portion, when a force is applied to the display member, the projection engaging the planar portion of the display member.

7. The display system of claim 6, wherein the hinge portion being formed from a resiliently flexible material and formed of one piece with the engagement portion, which allows the sign holding portion of the display member to flex in relation to the support body when a force is applied to the display member.

8. The display system of claim 6, wherein the sides of the support body taper outwardly adjacent a lower end thereof.

9. The display system of claim 6, wherein the support body includes a shelf portion adjacent a lower end which engages the display member when the display member is connected with the support body.

10. The display system of claim 6, wherein the sign holding portion includes first and second spaced walls which define a channel for selectively receiving a sign and a plurality of resiliently flexible fins extending into the channel from the walls for frictionally gripping the associated sign therebetween.

11. A display system comprising:

a generally planar support body having opposed first and second surfaces;

a mounting member extending from the first surface of the support body for selectively engaging an associated fixture;

a display member selectively connectable with the support body such that it extends from a second surface of the support body, wherein at least one of the display member and the support body includes a binge portion which allows at least a portion of the display member to pivot in relation to the support body when a force is applied to the display member, the support body including:

a projection extending from the second surface, the projection engaging a planar portion of the display member when the display member is connected with the support body, and a shelf extending from the second surface adjacent a lower end of the support body which engages the display member when the display member is connected with the support body.

12. A mounting bracket for selectively mounting an associated display member to an associated fixture comprising:

a generally planar support body including:

at least one groove located on a first surface thereof for selectively receiving a flange on the associated display member;

at least one mounting member extending from the first surface of the support body for selectively engaging the associated fixture;

a shelf extending from a second surface of the support body, wherein said shelf contacts a generally planar portion of the associated display member when the display member is received on the support member, the generally planar portion of the display member being connected with the flange; and a projection, extending from the second surface of the support body, the projection frictionally engaging the generally planar portion of the associated display member when the display member; is received on the support member.

13. A mounting bracket for selectively mounting an associated display member to an associated fixture comprising:

a generally planar support body including:

at least one groove located on a first surface thereof for selectively receiving a flange on an associated display member;

at least one mounting member extending from the first surface of the support body for selectively engaging an associated fixture;

a shelf extending from a second surface of the support body, wherein said shelf contacts a generally planar portion of the associated display member when the associated display member is received on the support member, the generally planar portion of the associated display member being connected with the flange, the at least one groove being tapered adjacent the shelf.

14. A method of displaying a sign comprising:

mounting a support body on a suitable fixture;

connecting a display member with the support body, the display member including a hinge portion which flexes when a force is applied to a portion of the display member and returns generally to its original position when the force is removed, including:

sliding a generally planar portion of the display member over a surface of the support body, flanges extending from the generally planar portion engaging an opposite surface of the support body, thereby gripping the support body between the flanges and the planar portion, a projection on the surface of the support body engaging the planar portion of the display member to resist displacement of the display member from the support body; and inserting the sign in a channel formed in the distal end of the display member.

15. The method of claim 14, wherein the step of mounting the support body includes:

inserting fingers on the support body in suitably positioned openings in the fixture.

* * * * *